US006385776B2

(12) United States Patent
Linday

(10) Patent No.: US 6,385,776 B2
(45) Date of Patent: May 14, 2002

(54) MODULAR CAP ASSEMBLY

(76) Inventor: Nancy L. Linday, 170 Park Row #18E, New York, NY (US) 10038

( * ) Notice: Subject to any disclaimer, the term of this patent is extended or adjusted under 35 U.S.C. 154(b) by 0 days.

(21) Appl. No.: 09/799,656

(22) Filed: Mar. 5, 2001

Related U.S. Application Data

(63) Continuation-in-part of application No. 09/267,528, filed on Mar. 12, 1999, now abandoned.
(60) Provisional application No. 60/077,706, filed on Mar. 12, 1998.

(51) Int. Cl.[7] ..... A42B 1/00
(52) U.S. Cl. ..... 2/171.1; 2/181; 2/195.1; 2/209.11
(58) Field of Search ..... 2/171.1, 10, 12, 2/181.4, 195.1, 209.11, 195.2, 209.13, 200.1, 244

(56) References Cited

U.S. PATENT DOCUMENTS 5,685,017 A * 11/1997 Kraft ..... 2/171.1
5,875,493 A * 3/1999 MacDonald et al. ..... 2/172
5,901,370 A * 5/1999 Linday ..... 2/10

* cited by examiner

*Primary Examiner*—John J. Calvert
*Assistant Examiner*—Katherine Moran

(57) ABSTRACT

The modular cap assembly of the present invention consists of a visor component and a crown component which may be worn separately or together. One or more of the crown panels may receive detachable insignias and detachable pockets. Other accessories may also be attached to the visor and the crown.

20 Claims, 31 Drawing Sheets

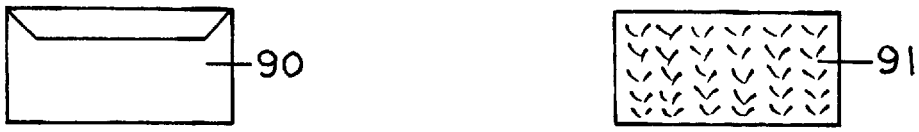
FIG. 10
FIG. 11
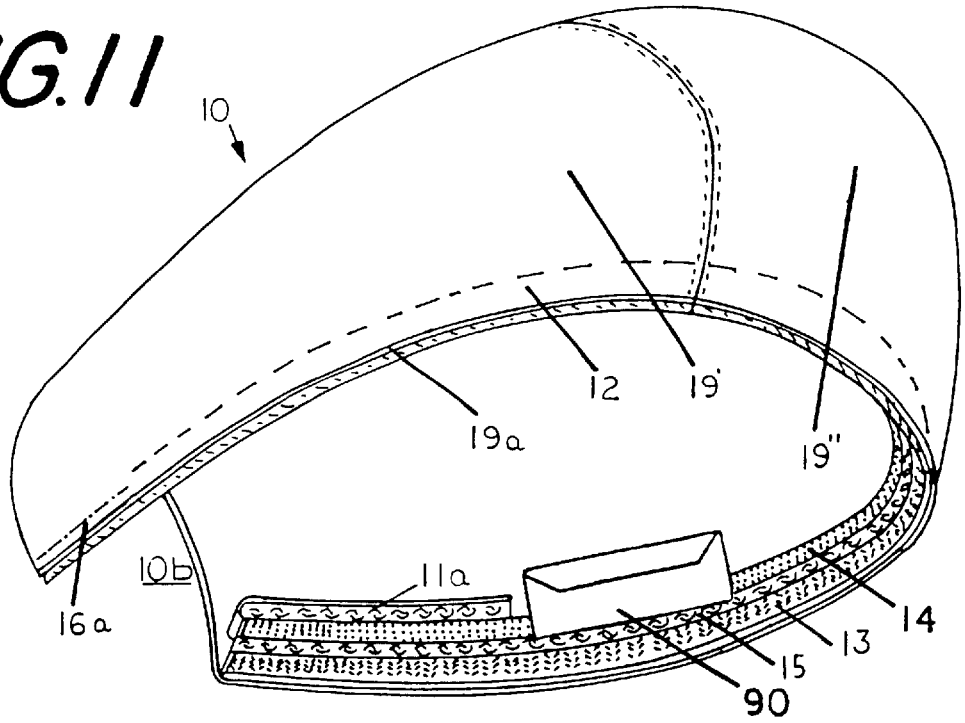

MODULAR CAP ASSEMBLY

CROSS-REFERENCES TO RELATED APPLICATIONS

This application is a Continuation-In-Part of Ser. No. 09/267,528, filed Mar. 12, 1999, now abandoned, which is entitled to the benefit of Provisional Patent Application Serial No. 60/077,706, filed Mar. 12, 1998, each of which is hereby incorporated by reference.

FIELD OF INVENTION

This invention relates to modular caps. In particular, the invention relates to modular caps with detachable and interchangeable components and detachable pockets and detachable logos that can be selectively displayed on and removed from these detachable, interchangeable components.

DISCUSSION OF PRIOR ART

Caps and headgear, though always a very popular addition to the clothing worn by people, have been worn principally for functional reasons such as protecting an individual's face from the sun or keeping his or her head warm. Recently, however, there has been a major shift in the basic reason people wear headgear, especially in young people.

Caps such as baseball-type caps are being worn in different ways than originally intended. Young people, for example, wear them with the bill in different positions as a means of self-expression, individual, and group identity. Brimless caps, which are baseball-type caps consisting of the crown without the bill, have become an important part of the cap market directed at youth. For example, brimless caps with collegiate logos are sold on college campuses across the country. At amusement parks, brimless caps are sold with the amusement park's own logo on them.

Various caps having detachable and interchangeable components are known in the prior art and provide for many configurations of the components.

U.S. Pat. No. 5,875,493 to MacDonald et al. teaches a scarf-like headcover which can only be worn when attached to a head-encircling member such as a headband. The visor in this invention can only be worn when attached to said headband. MacDonald teaches the attachment of a pair of side flaps that can be detachably attached in varying combinations. These side flaps cannot be worn with the visor without the use of the separate headband. The side flaps cannot be worn with the scarf-like headcover without the use of the separate headband. In this patent, none of the previously described elements can display insignia patches that can be removably affixed. Nor can the back closure of the head encircling headband display insignia patches that can be removably affixed.

U.S. Pat. No. 5,715,534 to Mobley teaches a crown that can be worn without a detachable brim. The track mechanism in this patent is made of a flexible semi-rigid material such as extruded polyvinyl chloride, sandwiched between the lining and the crown. Semi-rigid material cannot mold to the shape of head the way fabric and hook and loop tape material can. The semi-rigid material prevents the crown from developing the unique fit over time that makes an old cap so comfortable for an individual to wear. There is no mechanism in this patent for covering the ears, thus limiting its use to warm weather. There is also no mechanism for completely covering the neck. In addition, any decoration is permanently affixed and cannot be selectively removed or repositioned to be displayed on other parts of the invention.

U.S. Pat. No. 5,481,759 to Rinaldi teaches an elastic head covering portion made from a SPANDEX or stocking-like material. The wearer can select to cover his or her head with this elastic portion only. Affixed by stitching to the outer surface of the elastic material at the front of the hat is a flexible material portion, to which a bill or visor is stitched. This elastic portion is therefore not a brimless cap.

U.S. Pat. No. 2,577,717 to Stevens teaches a fold-down sweatband for the purpose of inserting an identification card in a transparent identification window. This fold-down sweatband is not worn in a folded position. It is worn in a standard position inside a hat with a brim and it does not function to enable the crown of the hat to be worn without the brim.

U.S. Pat. No. 5,471,684 to Casale teaches a convertible sports cap with sliding brim. There is no mechanism for the crown to be worn as a brimless cap in this invention.

U.S. Pat. No. 4,023,212 to Huffman teaches an adjustable visored cap with interchangeable crown. There is no mechanism for the crown to be worn as a brimless cap in this invention.

U.S. Pat. No. 4,873,726 to Tapia teaches an adjustable baseball-type cap assemblage having a crown portion and various interchangeable visor portions. Tapia teaches insignia patches of various styles that can be removably affixed to the selected visor and crown portions. As there is no mechanism in this patent for the crown to be worn as a brimless cap, these insignia patches cannot be displayed on the crown worn as a brimless cap. Tapia does not teach a mechanism for these insignia patches to be removably affixed to the back closure of the visor and the crown, nor on removable ear coverings nor on a removable neck curtain.

U.S. Pat. No. 5,136,726 to Kellin et al. teaches an article of apparel having one or more detachable decorative elements replaceably coupled thereto. It does not teach the use of detachable decorative elements on a brimless cap, on the back closure of a cap, brimless cap, or visor, on ear coverings or on a neck curtain.

U.S. Pat. No. 4,451,935 to Henschel teaches an inner and outer pocket in the crown of a standard cap, This crown cannot be removed and it cannot be worn as a brimless cap. This patent does not teach the art of an inner and outer pocket in a crown that can also be worn as a brimless cap. Furthermore, it does not teach the art of a pocket that can be selectively worn on the back closure of either a cap, a visor or a brimless cap.

U.S. Pat. No. 4,941,210 to Konucik teaches a quick-change sweatband or pad in which one embodiment is a headband from which a sweat-absorbing pad can be removed by the use of hook and loop pile fastener. The closure for the sweatband in this invention does not utilize hook and loop pile as a fastening technique. Neither detachable logos nor detachable pockets can be displayed on either the body of the sweatband or on the back closure.

U.S. Pat. No. 5,685,017 to Kraft teaches a hat crown connecting to a separate headband. The crown in this invention cannot be worn as a brimless cap without the addition of a separate headband. Kraft teaches the attachment of ear muffs over the separate headband. In addition, Kraft teaches the attachment of a neck curtain over the separate headband. In this patent, neither the ear muffs nor the neck curtain can be attached to the visor without the use of a separate sweatband. Nor can either the ear muffs or the neck curtain be attached to the crown without the use of a separate sweatband. Kraft does not provide any mechanism for the display of insignia patches that can be removably affixed to the back closure of the visor and the crown, whether worn separately or as a unit. Neither does Kraft provide any mechanism for the display of insignia patches that can be removably affixed to the removable ear coverings and the removable neck curtain.

U.S. Pat. No. 4,551,859 to Gerhardt teaches a cap provided with integral ear flaps that are self-stowing in the interior of the cap. These ear flaps are not detachable.

U.S. Pat. No. 5,384,916 to Portney teaches a size adjustable cap utilizing an adjustment strap with loop fasteners covered by a strip of fabric material facing outwardly from a user. Ornamental badges cannot be selectively attached to this adjustable strap.

U.S. Pat. No. 5,091,995 to Oates teaches a sports cap with a crown having front and rear brims in which only the rear brim is removable. The crown in this invention cannot be worn as a brimless cap. Oates does not provide any mechanism for the display of insignia patches that can be removably affixed to the back closure of the visor. Neither does Oates provide any mechanism for the display of insignia patches that can be removably affixed to the removable rear brim or any other portion of the sports cap.

U.S Pat. No. 5,099,524 to Linday provides a means to wear the crown as a brimless cap by assembling the crown over a separate sweatband component formed having a forward part made of hook and loop tape hook-portion-engaging material. In this patent, the crown cannot be worn as a brimless cap without the use of this separate sweatband component. The need for a separate sweatband to enable a crown to be worn as a brimless cap presents major drawbacks in using a cap invention as a marketing item with youth. The separate sweatband is easily lost, as it is not permanently attached to the crown. The sweatband adds expense to the invention as it is not only separate from the basic unit but must also be covered with hook and loop tape hook-engaging material. The separate sweatband requires that an additional, separate piece be acquired in order that the cap invention be worn as a brimless cap in addition to being worn as a cap and a visor.

U.S. Pat. No. 5,901,370 to Linday is a Continuation-In-Part of U.S. Pat. No. 5,099,524. This patent to Linday does not provide any mechanism for the display of insignia patches that can be removably affixed to the back closure of the visor and the crown, whether worn separately or as a unit. Nor does this patent to Linday provide any mechanism for the display of insignia patches that can be removably affixed to the removable ear coverings and the removable neck curtain. This patent to Linday does not provide any mechanism for a detachable pocket to be removably affixed to the inside of the crown when the crown when the crown is attached to the visor. This patent also does not provide any mechanism for a detachable pocket that can be removably affixed to the back closure of the visor and the crown, whether worn separately or as a unit. Nor does this patent to Linday provide any mechanism for a detachable pocket to be removably affixed to the removable ear coverings and the removable neck curtain.

SUMMARY OF THE INVENTION

The core of the modular cap assembly of the present invention consists of two selectively detachable elements, a visor component having a forehead or billboard portion made of velcro hook-adhering fabric, and a crown component with a permanent fold-down sweatband that allows it to be worn as a brimless cap or "beanie" when separated from the visor. These two selectively detachable elements can be worn assembled as a cap, or each one can be worn separately as a distinct piece of headwear. The selectively detachable crown can be made in any silhouette, in any material, and with any back closure known in the art of making caps, visors, and brimless caps or "beanies". In addition, one of more of the panels of the selectively detachable crown can be made of velcro hook-engaging material, allowing the selective display of detachable insignias and detachable pockets with velcro loop-engaging material permanently affixed on back of them. Selectively detachable ear coverings and a selectively detachable neck covering can be removably attached to the visor and crown when assembled as a cap, or can be removably attached to the visor when worn as a separate piece of headwear or to the crown when worn separately as a brimless cap or a "beanie". The outside face of these selectively detachable ear coverings and neck covering can be made of any material. When the outside face of these selectively detachable ear coverings is made of velcro hook-engaging material, selectively detachable insignias and detachable pockets with velcro loop-engaging material permanently affixed on back of them can be displayed on them. The selectively detachable crown and the selectively detachable visor can be fitted to the head and made in different sizes. The selectively detachable crown and the selectively detachable visor can also be adjustable to different head sizes. The adjustable back closures can be selected from the full range of back closures used in the cap industry for caps, visors, brimless caps and beanies as well as from uniquely designed back closures. The adjustable back closures for the detachable crown and visor can also be made of velcro hook-engaging material. Selectively detachable insignias and selectively detachable pockets with velcro loop-engaging material permanently affixed on back of them can be removably attached to these back closures of the crown and the visor made of velcro hook-engaging material when worn assembled as a cap or worn as separate units. These selectively detachable insignias and pockets can be removably attached to the billboard of the visor. The selectively detachable pocket with velcro loop-engaging material permanently affixed to the back of it can be removably attached to the inside of the fold-down sweatband when the crown is assembled over the visor. Selectively detachable logos and selectively detachable pockets with a loop backing can be worn over the back closures of the crown and visor when assembled as a cap unit or when assembled as separate units.

BRIEF DESCRIPTION OF THE DRAWINGS

FIG. 10 is a detailed view of a detachable pocket with velcro loop-adhering material permanently affixed to the back of it.

FIG. 11 is a perspective view of a first embodiment of the modular cap assembly of the present invention with a detachable pocket selectively attached to the upper section of the fold-down sweatband in the crown.

DESCRIPTION OF THE PREFERRED EMBODIMENTS

Eleven detailed embodiments of the present invention are disclosed herein. It should be understood, however, that the disclosed embodiments are merely exemplary of the invention, which may be embodied in various other forms. Therefore, the details disclosed herein are not to be interpreted as limited, but merely as the basis for the claims and as a basis for teaching one skilled in the art how to make and/or use the invention.

Figure 1:
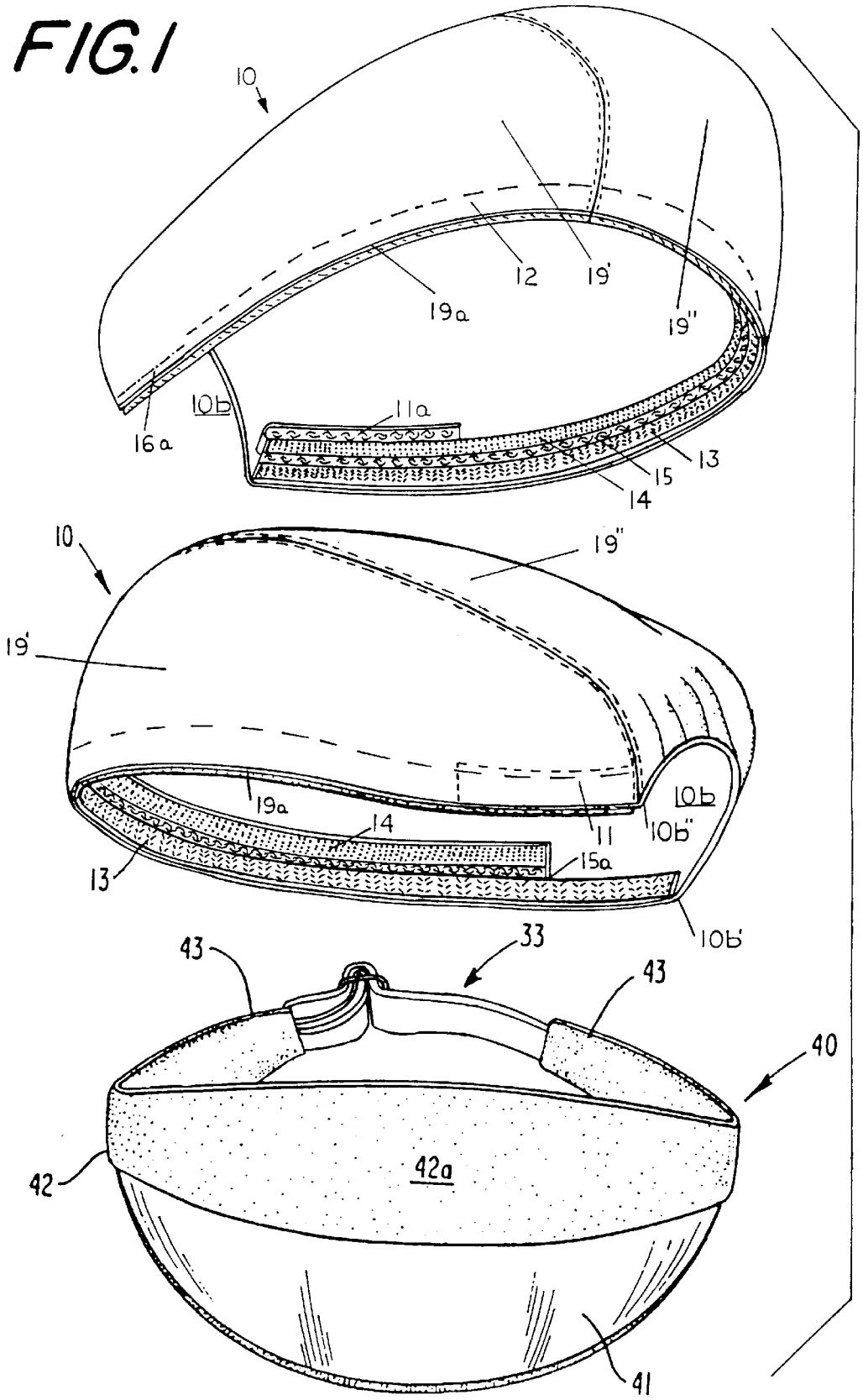
FIG. 1 is a perspective view of a first embodiment of the modular cap assembly of the present invention.

With reference to the preferred embodiment of the invention as shown in FIG. 1, crown 10 displays a specific type of crown that includes side crown portions 19' and a central crown portion 19", although it should be noted that the invention is not limited to a particular crown or bill shape or material and in fact works with any number of crown and bill shapes, conventional materials and materials of relative rigidity, including very flexible or "floppy" crowns as well as bills that flip up. The invention is not limited to a particular back closure for either the crown or the visor. The back closures in the crown and the visor provide that the circumference of each component is adjustable to fit a range of head sizes. The back closures can be selected from the full range of back closures used in the headwear industry for caps, visors, brimless caps and beanies including, but not limited to, plastic tabs; straps of all different types of materials with all different types of buckles, snaps, and sliders made of all different types of materials; all different types of zippers made of all different types of materials; elastic; elastic covered with fabric; elastic covered with fabric and shirred; elastic in combination with all different types of buckles, snaps, and sliders made of all different types of materials; all different types of stretch fabric; and all different types of stretch fabric with all different types of buckles, snaps, and sliders made of all different types of materials. All different types of stretch fabric can be used to permanently cover the opening 10*b* at the back of the crown 10 while still providing for a fit for a range of head sizes. The opening 10*b* at the back of the crown 10 can be covered with any type of fabric with a section of elastic or other stretchable material fixedly adhered to the bottom of it to provide for a fit for a range of head sizes. The crowns and visors described in all the embodiments are interchangeable.

FIG. 1 illustrates a first preferred embodiment of a modular cap assembly constructed in accordance with the teachings of the present disclosure. First segmented cap assembly includes a crown component 10, a fold-down sweatband 12, and a visored headband component 40. The crown component 10 is detachably connectable to the visor component 40. The crown component 10 can be worn separately, as can the visored headband component 40.

Crown component 10 of the first modular cap assembly generally comprises a body of flaccid material having a hemmed lower edge 19*a* and a length of the hook portion of hook and loop tape material 13 fixedly attached to the fabric backing 15 adjacent to the hemmed lower edge 19*a* from the right lower edge of the back opening 10*b*' to the start 15*a* of the fabric backing 15 of the fold-down sweatband. At the start 15*a* of the fabric for the fold-down sweatband, the length of the hook portion of hook and loop tape material is fixedly attached to the inside portion of the body of flaccid material with the fabric backing 15 of the fold-down sweatband sandwiched in between. As a result, both the hook and loop tape material and the fold-down sweatband are fixedly attached to the inside portion of the body of flaccid material around the circumference of the crown adjacent to the hemmed lower edge 19*a* to the left back opening 10*b*". The strip of velcro hook 13 forms the crown attachment means.

In the first preferred embodiment of the modular cap assembly the fold-down sweatband 12, extends from the rear part of the crown component 10 in a continuous length around the side crown portions 19' and the forward part of the central crown portion 19". The extended section of fabric with the loop portion of hook and loop tape material 11*a* is folded behind the top of the fold-down sweatband 14 and the flaccid material in the side of the crown 19' so that it does not show in the rear portion of crown component 10 formed having an arched opening 10*b*. The placement of the extended section of material with sides 11 and 11*a* from the fold-down sweatband 12 and the start of the fold-down sweatband 15*a* can be reversed. The length of the hook portion of hook and loop tape material 13 can be fixedly attached to the inside portion of the body of flaccid material adjacent to the hemmed lower edge 19*a* from the left lower edge of the back opening 10*b*" to the start 15*a* of the fabric backing 15 of the fold-down sweatband. The extended section of material can be folded back under the crown so that it does not extend past right back opening 10*b*' and does not show in the arched opening 10*b*. The outside surface of the crown, and particularly the forward part of the central crown portion 19" can be utilized for display of a company logo, trademark or tradename.

Visored headband component 40 includes a bill portion 41, a forehead portion 42, and a sweatband/lining portion 43. Bill portion 41 is preferably formed from a plastic material and covered with fabric. Forehead portion 42 is formed having a forward face 42*a*, also known as the billboard area of the visor, comprising hook and loop tape hook portion-engaging material. The forehead portion 42 is fixedly attached at the lower edge thereof to the bill portion 41 and extends beyond the sides of the bill portion 41 for a length substantially to the rear of the wearer's head. A strap and buckle assembly 33 is fixedly attached at respective ends of the forehead portion 42. As in the crown, the directions of the attachment for the back closure in the visor can be reversed. The strap and buckle assembly permits the circumference of the visor to be varied to accommodate individuals having a variety of head sizes. Sweatband/lining portion 43 of the visored headband component 40 comprises a length of moisture-absorbent material and is fixedly attached to the bill portion 41 opposite the attachment of said forehead portion 42. Sweatband portion 43 extends upwardly therefrom to the top of the inside of the forehead portion 42. Forehead portion 42 extends substantially vertical from the bill portion 41 and the front portion 42*a* provides an area for display of printed material, such as a company logo, trademark or tradename. Front portion 42*a* also provides an area for display of detachable logos and detachable pockets with velcro hook fixedly attached to the back of them. In addition, either type of detachable neck curtain and either type of detachable ear flaps can be selectively attached to the side portions 42.

Figure 2:
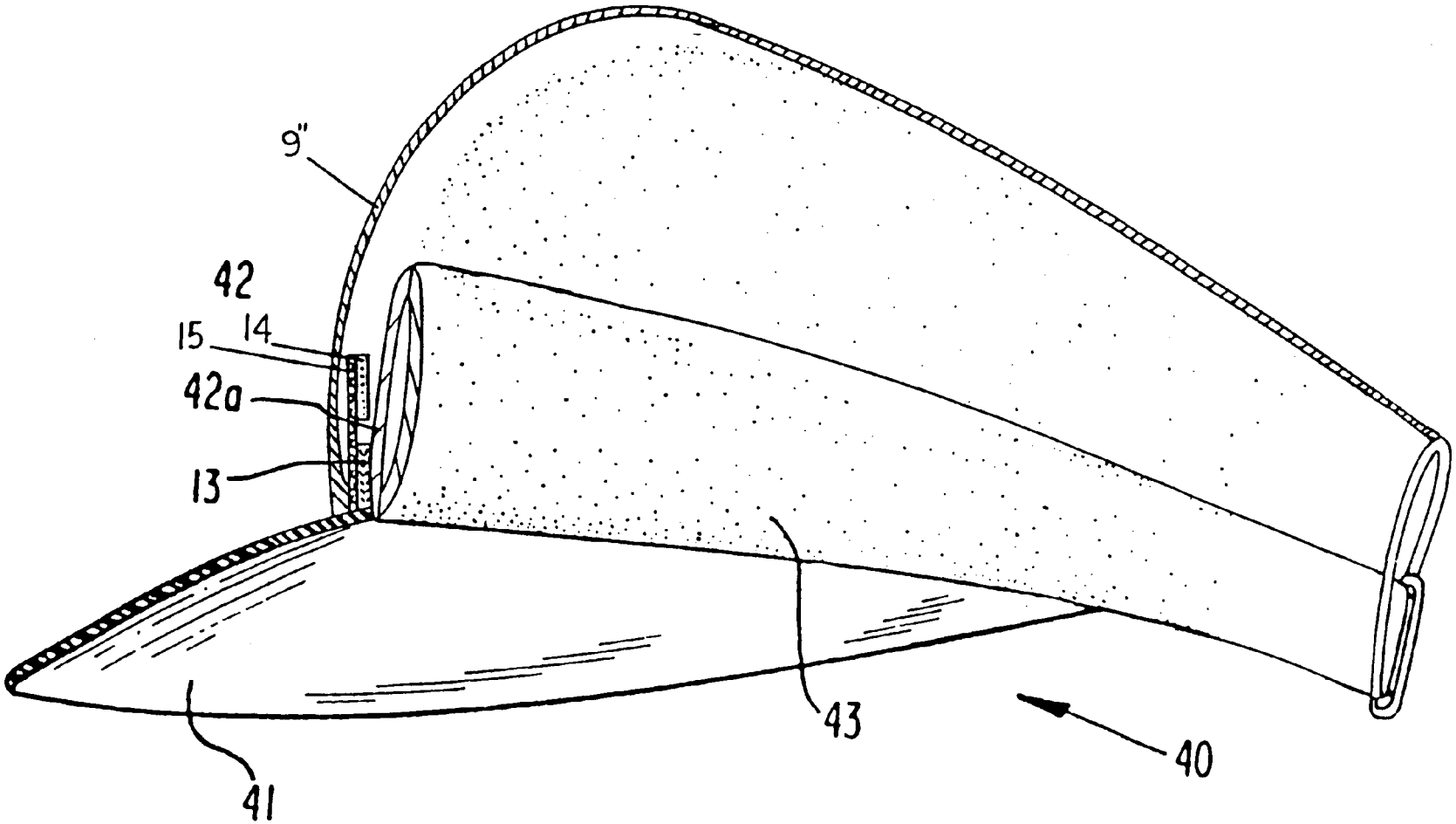
FIG. 2 is a side cross-sectional view of an assembled modular cap.

FIG. 2 is a side cross-sectional view of an assembled first modular cap assembly. At the front of the crown and forehead portion of the visor, fold-down sweatband 12 composed of fabric backing 15, loop portion of hook and loop tape material 14, and hook portion of hook and loop tape material 13, is sandwiched between flaccid material of the crown central portion 9" and the forward face of the forehead portion 42*a* of the visor comprising hook and loop tape hook portion-engaging material. The hook portion of hook and loop tape material 13 attaches to the hook and loop tape hook portion-engaging material 42*a* of the forehead portion of the visor to hold the crown and the visor together as a cap.

Figure 3:
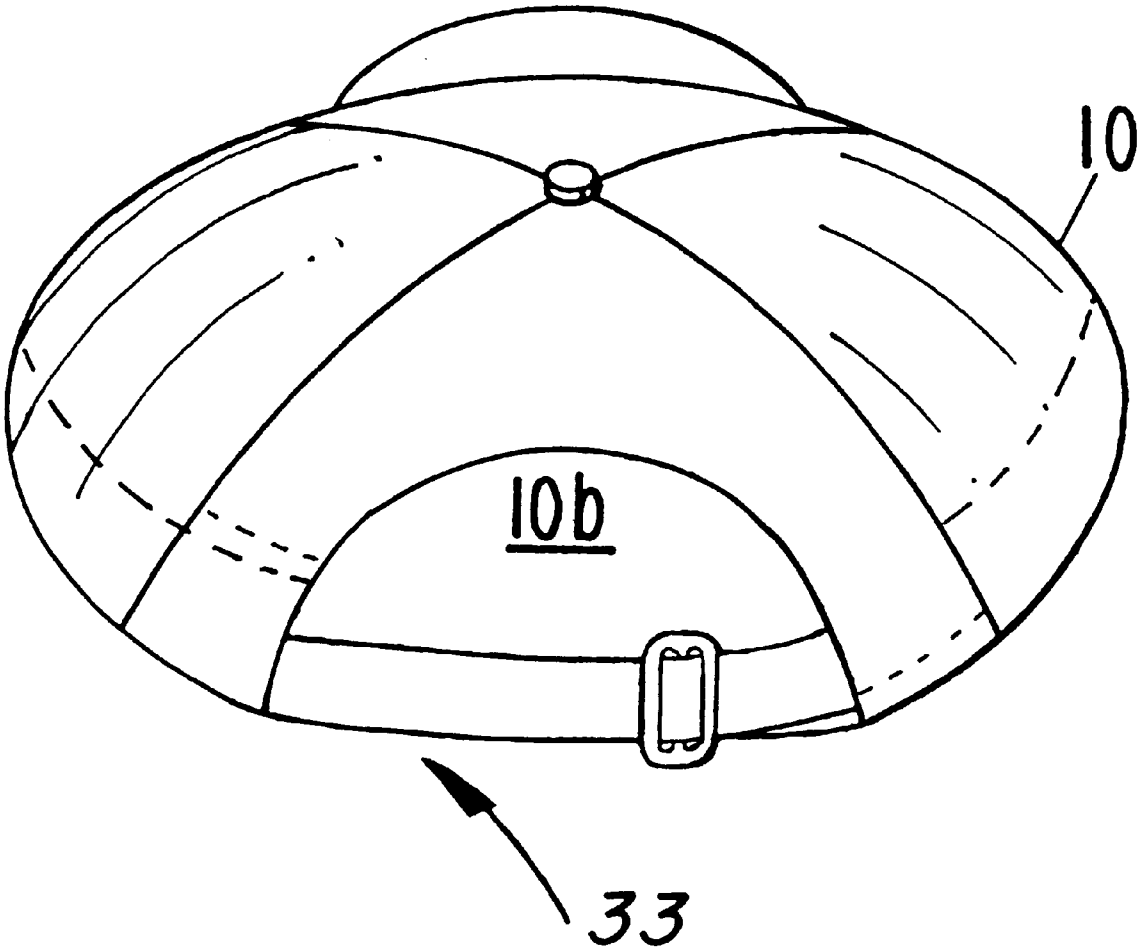
FIG. 3 is a rear view of the first embodiment of the modular cap assembly.

FIG. 3 is a rear view of the first embodiment of the modular cap assembly showing the strap and buckle closure 33 and the arched opening 10*b*. In this embodiment, the rear opening looks the same as the rear opening of a standard cap.

Figure 4:
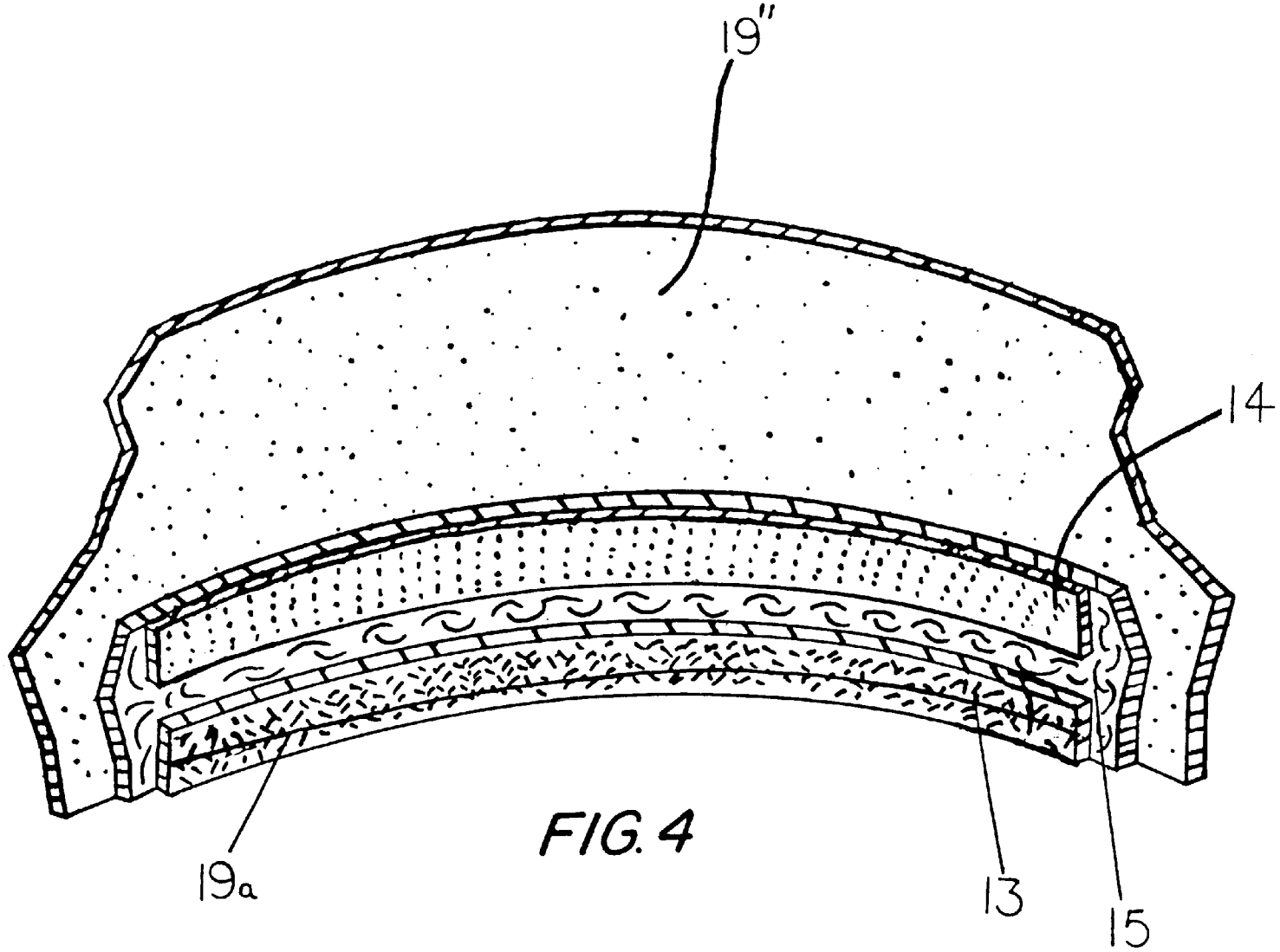
FIG. 4 is an exploded view of the fold-down sweatband.

FIG. 4 is an exploded view of the fold-down sweatband detailing the placement of the fabric backing 15 against the inner surface of the crown 19". The fold-down sweatband is fixedly attached to the crown at the lower edge of the hem 19*a* through both the hook portion of hook and loop tape material 13 and the fabric backing 15. The loop portion 14 is fixedly attached only to the fabric backing 15, leaving it free to fold over the hook portion 13 to form a sweatband for the crown so that it may be worn as a brimless cap. When the crown is worn separately as a brimless cap, the loop portion 14 is folded over the hook portion 13 such that the fabric backing 15 forms a sweatband for the brimless cap.

Figure 5:
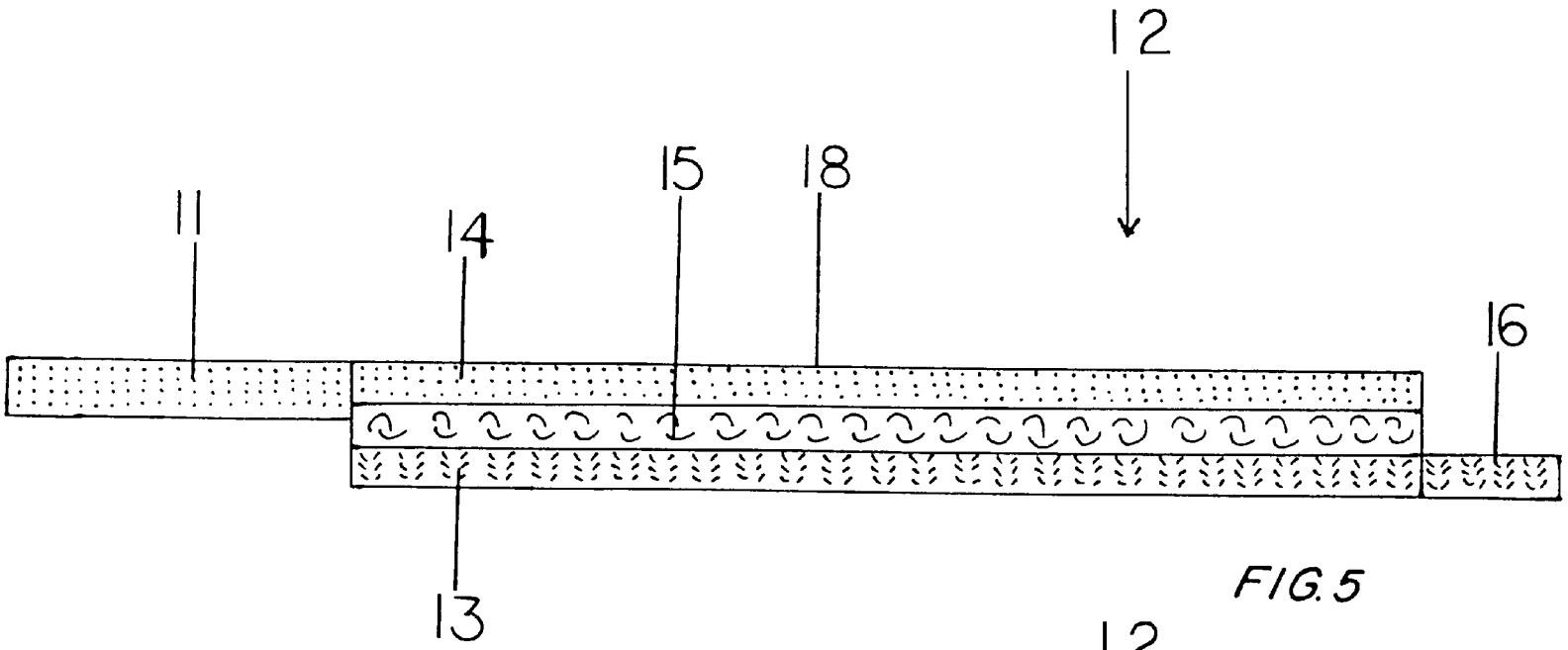
FIGS. 5 and 6 are detailed views of the fold-down sweatband of the first embodiment of the modular cap assembly.
Figure 6:
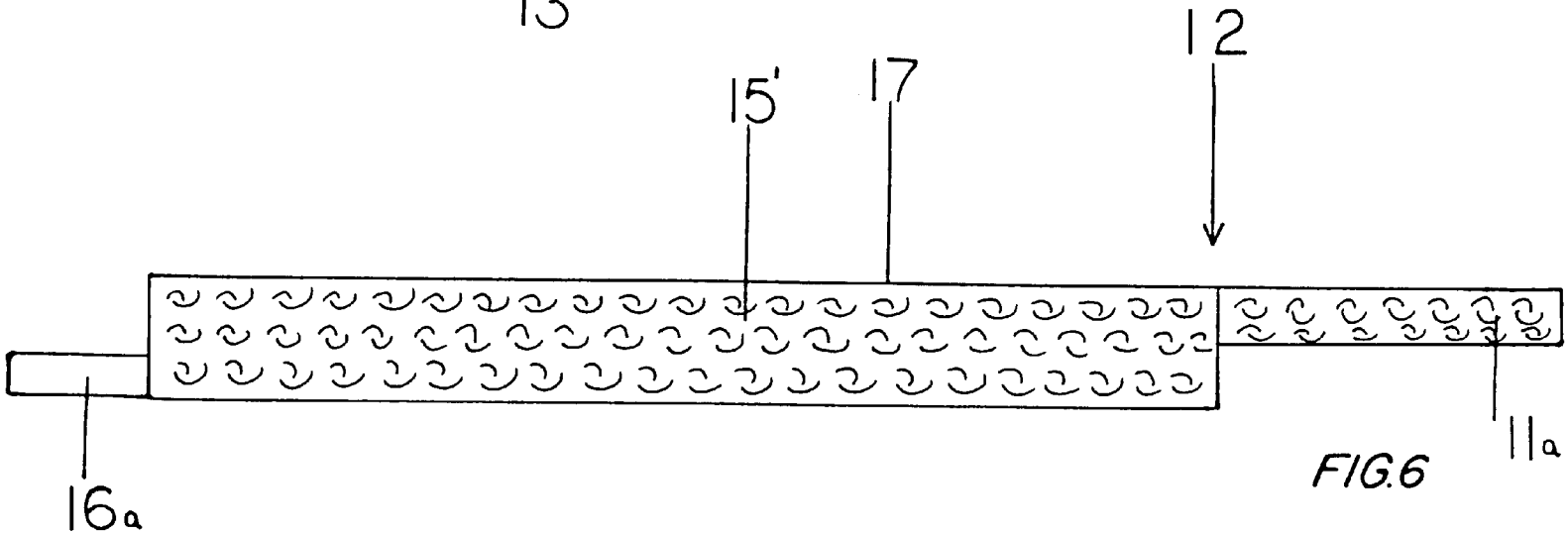

As shown in FIGS. 5–6, the fold-down sweatband is constructed from a strap of material 15 having a first end with inner surface 11 and an opposite face 11*a* and a second end with inner surface 16 and an opposite face 16*a*; these two ends are releasably secured together in a manner wherein the circumference of the crown component is adjustable to fit a range of head sizes. The first and second ends of the fold-down sweatband are secured together by hook and loop type material, wherein the first end with inner surface 11 is provided with the loop material and the second end with inner surface 16 is provided with the hook material. The strap of material 15 ends and the second end with inner surface 16 and an opposite face 16*a* is an extension of the hook material 13 fixedly attached at the bottom of the inner surface 18 on the fold-down sweatband 12. The outer surface 17 is composed of the fabric 15' that faces the inside of the crown. The inner surface 18 is the side of the fabric 15 onto which the velcro hook 13 and the velcro loop 14 are fixedly attached, with a section of the velcro hook 13 extending to form the second end with inner surface 16 and outer surface 16*a*.

Figure 7:
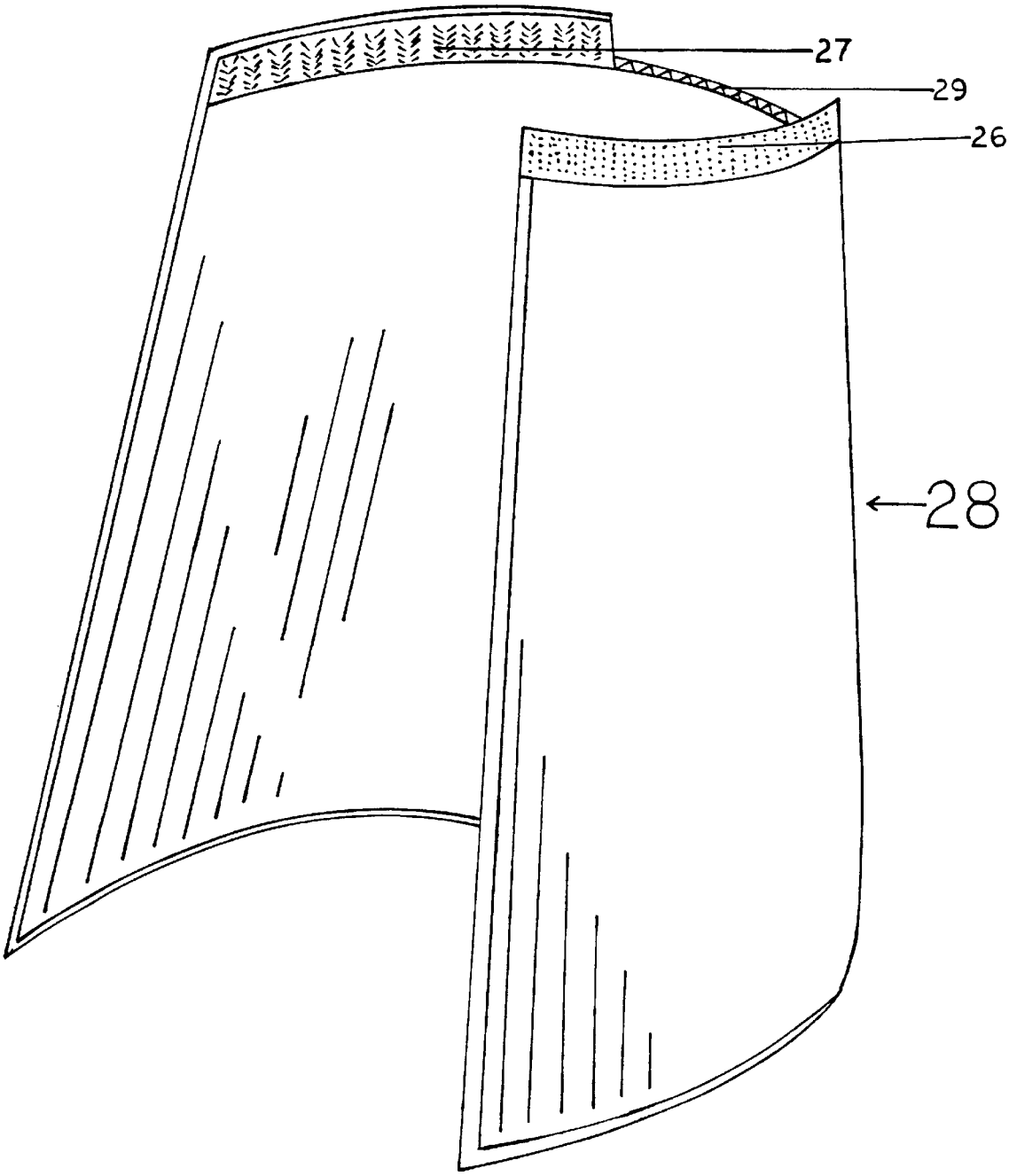
FIG. 7 is a detailed view of a detachable neck curtain.

FIG. 7 shows a selectively attachable neck curtain 28 with an outer top surface 26 having attachment means which may be formed from velcro hook-engaging material an inner top surface 27 which may be formed from velcro loop-engaging material, and a top edge portion 29. The neck curtain 28 is selectively attachable to the crown or visored components of any of the embodiments when assembled as a cap unit or when worn as separate pieces of headwear.

Figure 8:
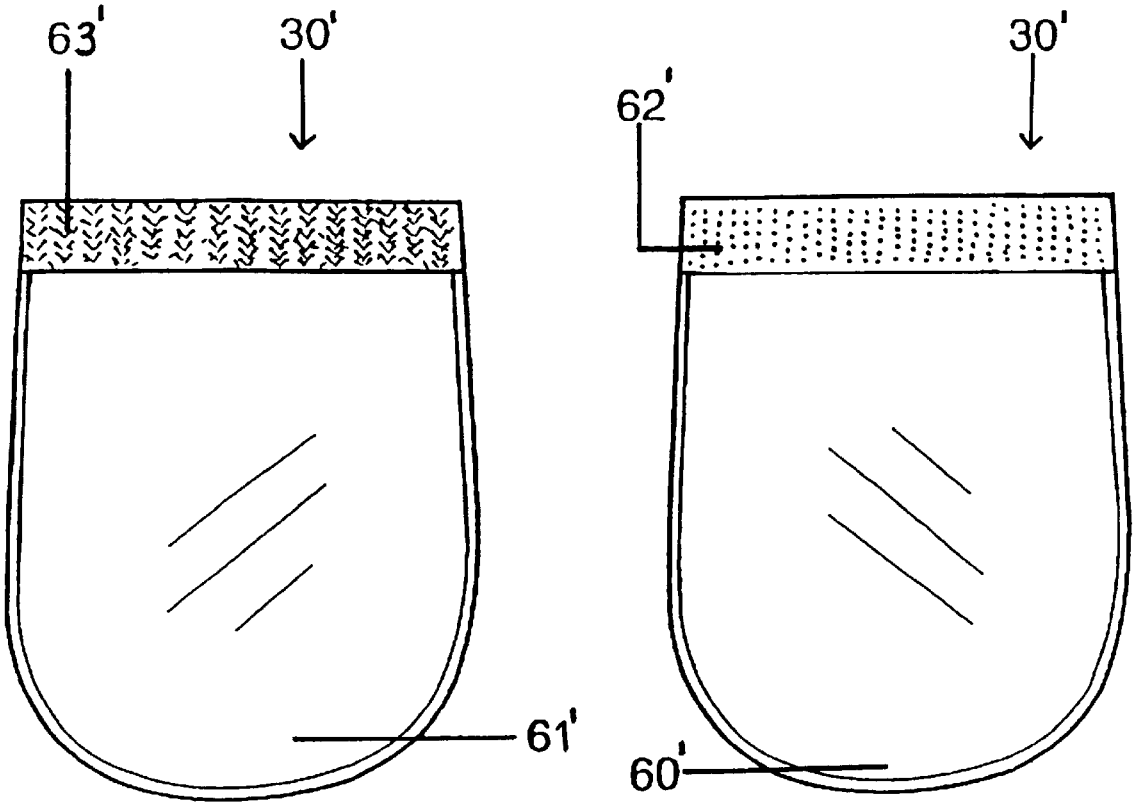
FIG. 8 is a detailed view of the two sides of a detachable ear flap.

FIG. 8 shows a selectively attachable ear flap 30' with views of the inner surface 61' and outer surface 60' of the ear flap 30'. The outer surface 60' has an upper edge of velcro hook-engaging material 62' and the inner surface 61' has an upper edge of velcro loop-engaging material 63'. The hook and loop materials enable the ear flaps to be selectively attached to the crown or visored components of any of the embodiments when assembled as a cap unit or when worn as separate pieces of headwear.

Figure 9:
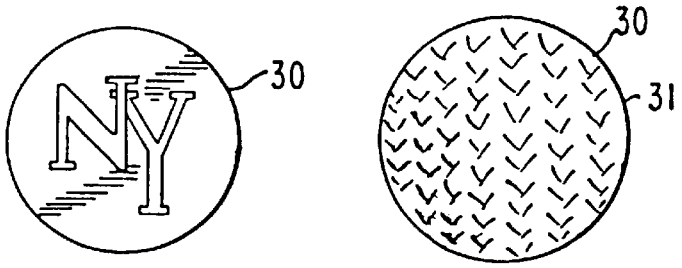
FIG. 9 is a detailed view of a detachable ornamental insignia with velcro loop-adhering material permanently affixed to the back of it.

FIG. 9 shows a selectively detachable insignia 30 with velcro loop-engaging material 31 formed on a rearward face.

FIG. 10 show a selectively detachable pocket 90 with velcro loop-engaging material 91 formed on a rearward face.

FIG. 11 is a detail of the crown 10 of the first embodiment of the modular cap assembly showing a detachable pocket 90 selectively attached to the velcro loop fabric 14 at the top of the fold-down sweatband 12. This assembly is possible with all the embodiments of the crown in the modular cap of the present invention when the crown is assembled over the visor.

Figure 12:
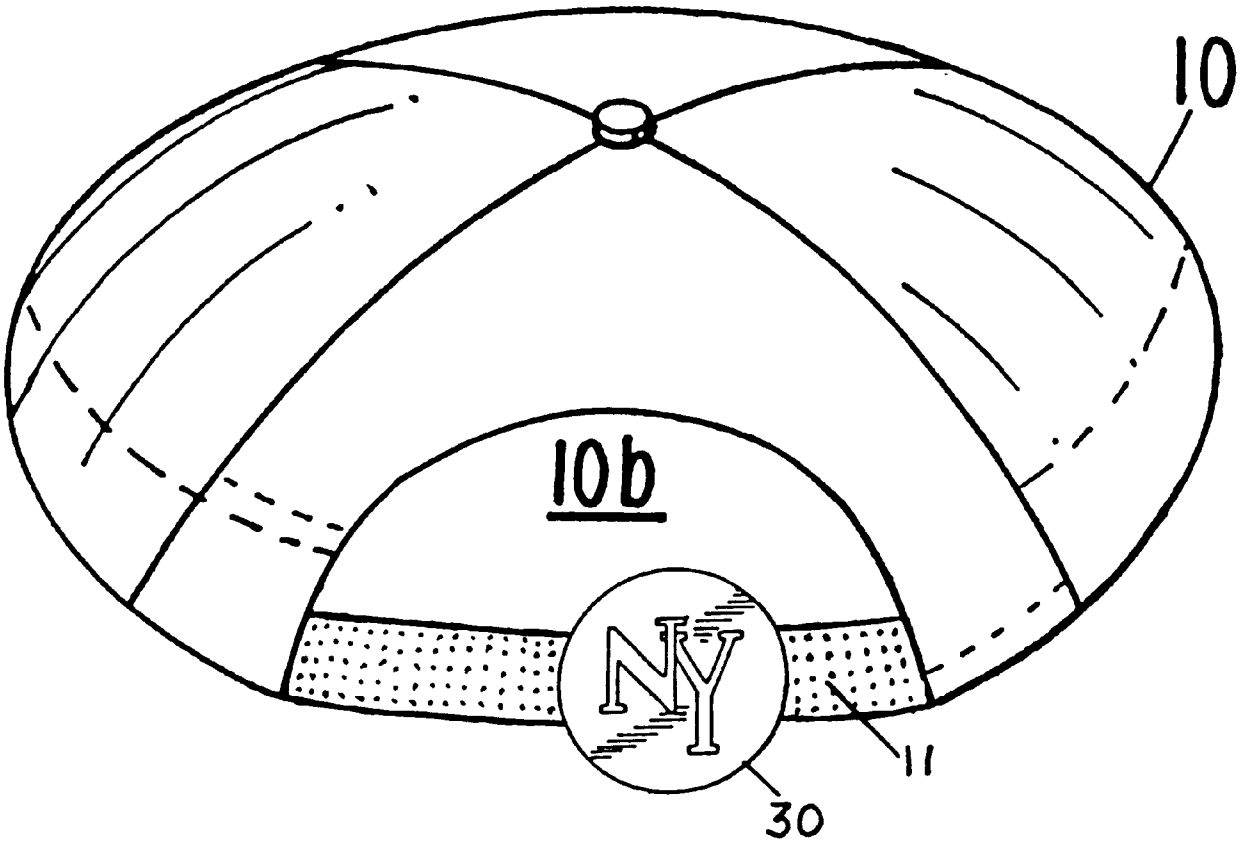
FIG. 12 is a detailed view of the first embodiment of the crown when it is assembled as a brimless cap or "beanie" with a selectively attachable insignia displayed on the back closure.

FIG. 12 is a detailed view of the first embodiment of the crown 10 when it is assembled as a brimless cap or "beanie". The upper edge of the fold-down sweatband is attached to the lower edge of the fold-down sweatband, with the result that the fabric backing 15' faces the head of the wearer. A section of material with the velcro loop portion of hook and loop tape adhering material 11 extends from one side of the back arched opening 10*b* where it is selectively attachable to the velcro hook portion 16 of hook and loop tape adhering material comprising part of the crown attachment means fixedly attached to the inside portion of the other side of the arched opening. A selectively attachable insignia 30 is displayed on the face 11 of the back closure facing towards the viewer. Selectively attachable pocket 90 can also be displayed in the same manner.

Figure 13:
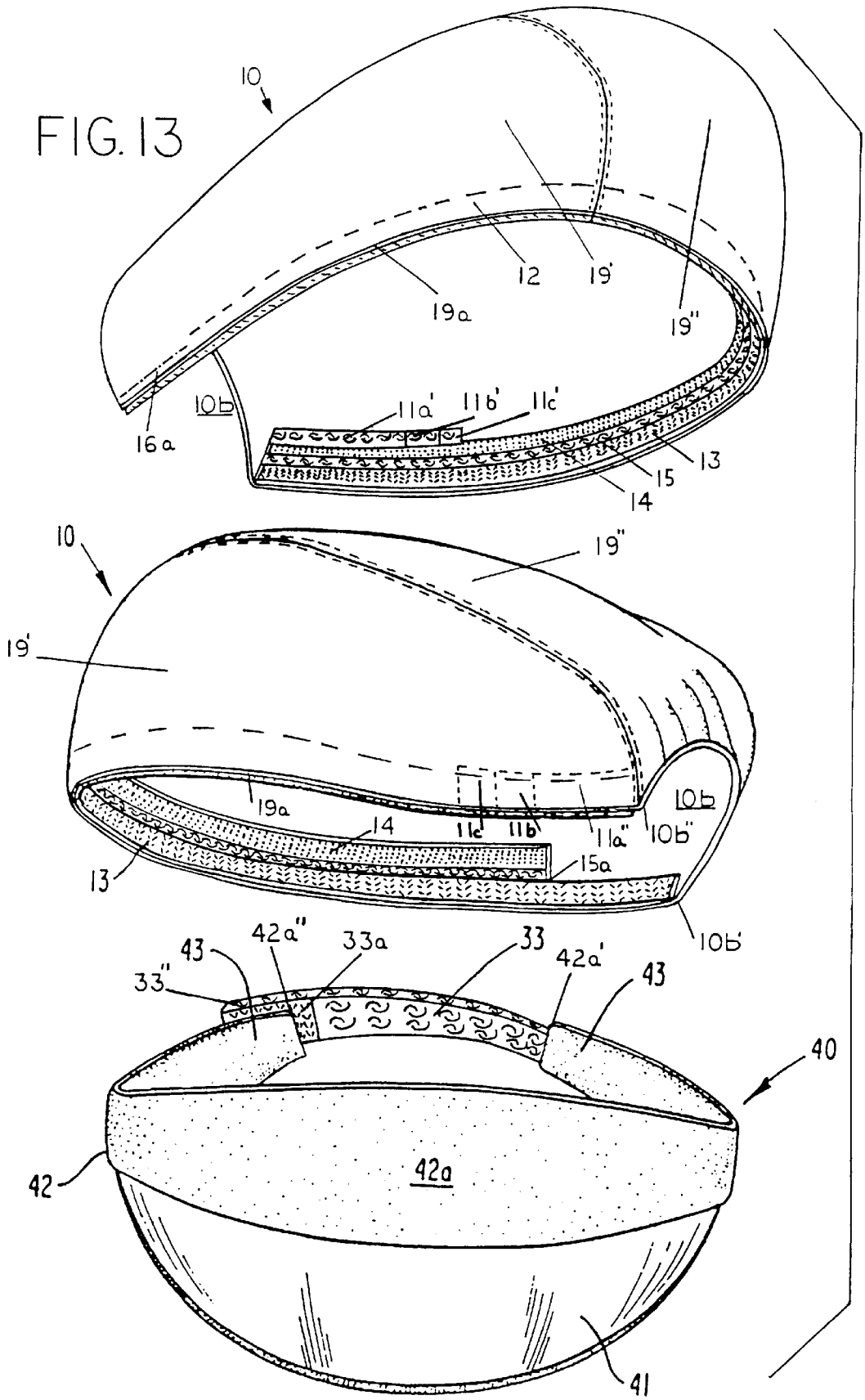
FIG. 13 is a perspective view of a second embodiment of the modular cap assembly of the present invention.
Figure 14:
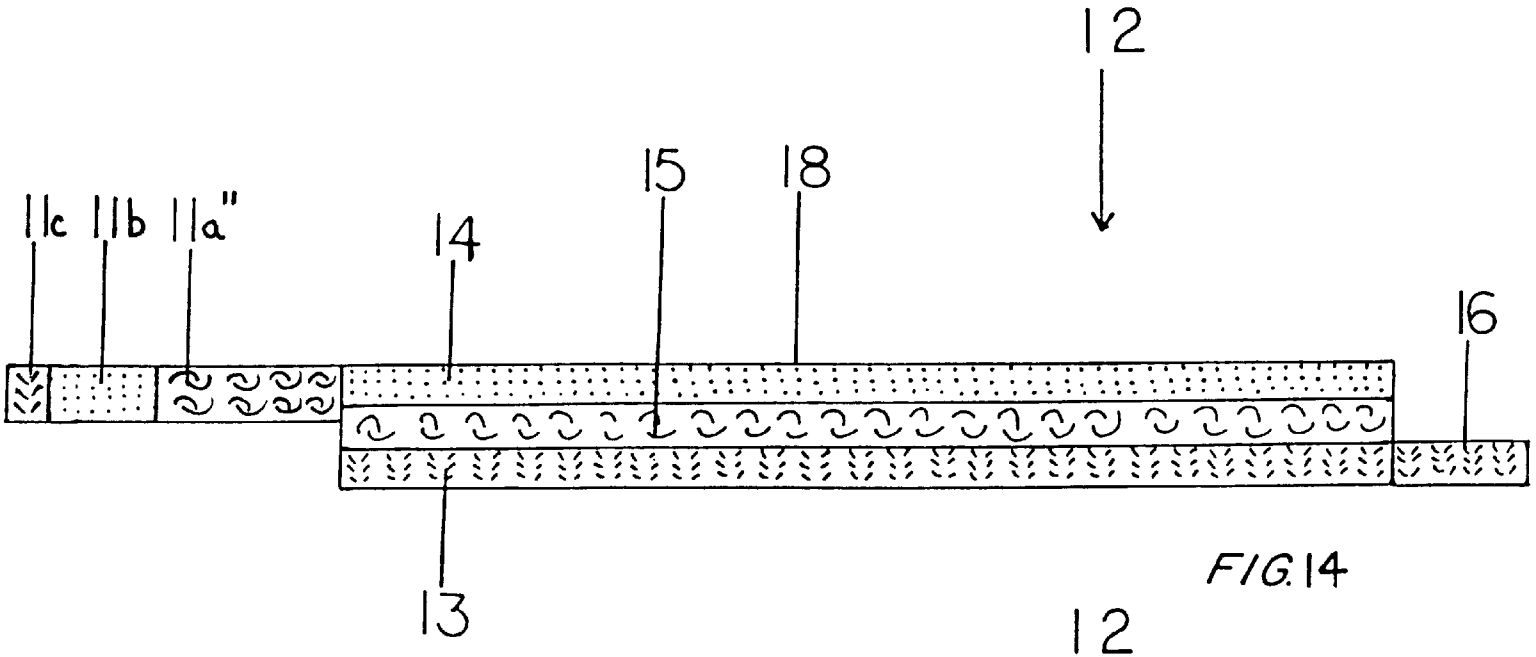
FIG. 14 is a detailed view of the side of the fold-down sweatband facing the visor in the second embodiment of the modular cap.
Figure 15:
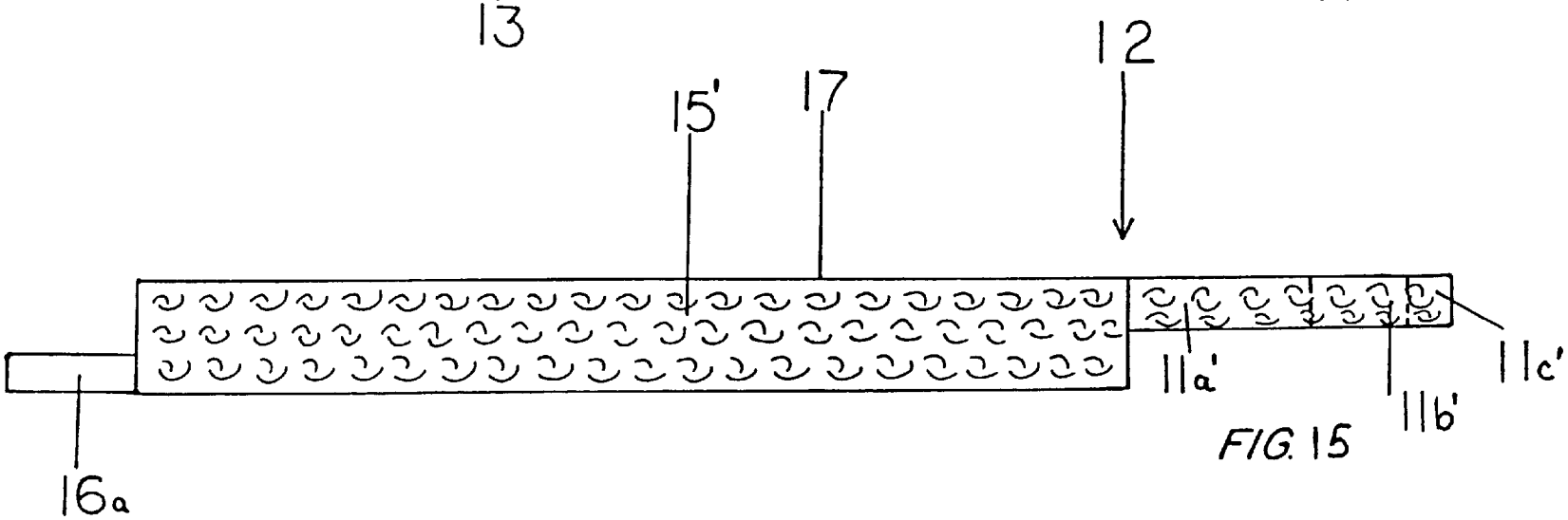
FIG. 15 is a detailed view of the side of the fold-down sweatband facing the crown in the second embodiment of the modular cap

FIG. 13 illustrates the second preferred embodiment of the modular cap assembly of the present invention. The difference between the first preferred embodiment and the second preferred embodiment of the modular cap assembly of the present invention is the back closure mechanism in the crown component 10 and the back closure mechanism in the visored headband component 40. The remainder of the invention is the same in the second embodiment as it is in the first embodiment. The back closures in the crown and the visor provide that the circumference of each component is adjustable to fit a range of head sizes. In the second preferred embodiment as shown in FIG. 13, the extended section of material with velcro hook-adhering material 11*b* and velcro loop-adhering material 11*c* is folded back under the crown and placed on top of the fold-down sweatband 12 where it is selectively attached to the loop portion 14 of the fold-down sweatband 12 by the velcro loop-adhering material 11*c* so that it does not extend beyond left back opening 10*b*" and does not show in the arched opening 10*b* at the rear portion of crown component 10. The opposite face of the extended section of material without the velcro loop and velcro hook sewn onto it, 11*a*', 11*b*' and 11*c*', is facing the wearer's head. As in the first embodiment, the placement of the extended section of material 11 from the fold-down sweatband 12 and the start of the fold-down sweatband 15*a* can be reversed.

Figure 16:
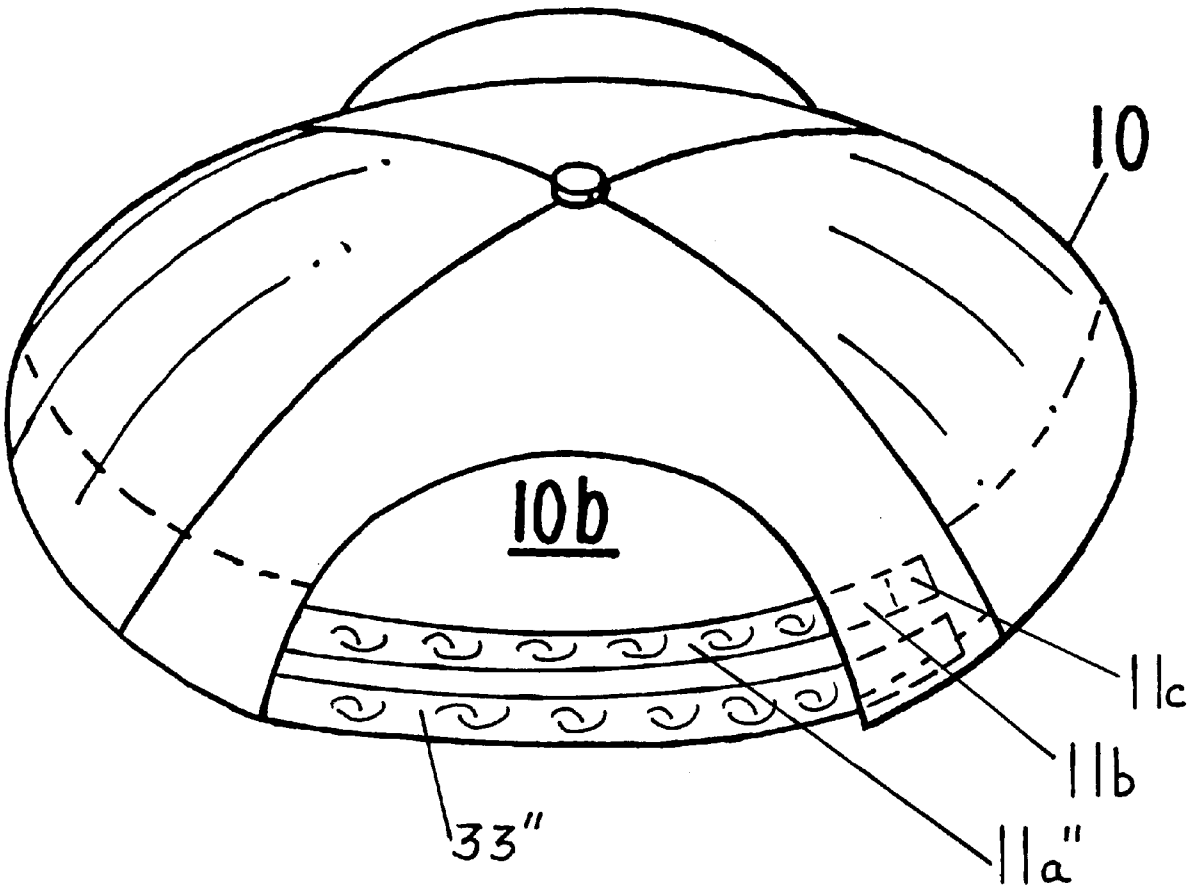
FIG. 16 is a rear view of the back closure in the second embodiment of the modular cap in which both the back strap of the crown and the back strap of the visor are extended over the back opening.

The back closure of the visor consists of an extended section of fabric with an inside face 33 and an opposite face 33" fixedly attached at the left end 42*a'* of the forehead portion 42. This extended section of fabric has a section of velcro loop-adhering fabric 33*a* permanently attached to the free end of it on the inside face 33" which can be selectively attached to the velcro hook-engaging material in the forehead portion 42 at the end 42*a*" forming the back closure of the visor. Both the inside face 33 and the opposite face 33' of the back strap of the visor are made of a material that is not velcro hook-adhering. As in the first embodiment, the directions of the attachment of the extended section of fabric can be reversed. In this embodiment, the permanent attachment of the crown back closure and the permanent attachment of the visor back closure are on the same side of the back opening so that they can be assembled to look like a double strap closure as shown in FIG. 16. In the second through the seventh embodiment of the modular cap assembly of the present invention, when the crown is assembled over the visor to form a cap unit the back closure mechansim of the crown can either (1) be extended over the back opening 10*b* to look like a double strap back closure, or (2) the back closure of the crown can be folded back inside of it so that the back closure of the crown does not show in the back opening 10*b*. The first gives a unique double strap closure while the second looks like a standard cap back closure.

Figure 17:
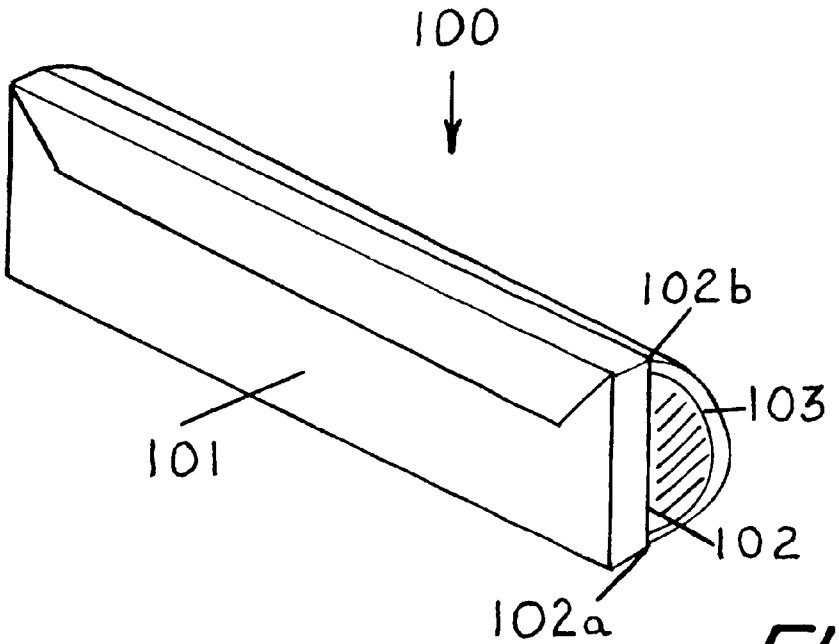
FIG. 17 is a view of a selectively attachable pocket with a sleeve attachment mechanism on its back side.

FIG. 17 is a detailed view of a second type of detachable pocket 100 that can be selectively attached to the back closure of the crown and the visor when assembled as a unit or to the back closure of each when worn as a separate piece of headwear. This type of detachable pocket 100 has a front face 101 and a back face 102 with a section of material that is permanently affixed to the top of the back face 102*b* and to the bottom of the back face 102*a* to form a sleeve 103. Sleeve 103 can be slipped over the back closures of any of the preferred embodiments of the present invention, but is particularly useful with those back closures that do not have velcro hook-adhering fabric permanently attached to the back of them.

Figure 18:
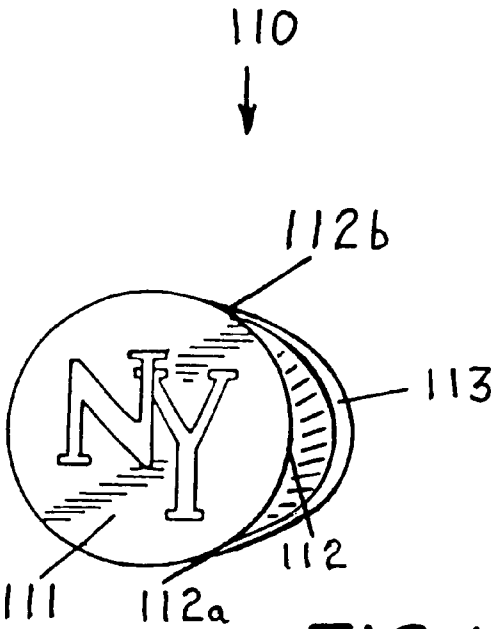
FIG. 18 is a view of a selectively attachable logo with a sleeve attachment mechanism on its back side.

FIG. 18 is a detailed view of a second type of detachable logo 110 that can be selectively attached to the back closure of the crown and the visor when assembled as a unit or to the back closure of each when worn as a separate piece of headwear. This type of detachable logo 110 has a front face 111 and a back face 112 with a section of material that is permanently affixed to the top of the back face 112*b* and to the bottom of the back face 112*a* to form a back sleeve 113. Sleeve 113 can be slipped over the back closures of any of the preferred embodiments of the present invention, but is particularly useful with those back closures that do not have velcro hook-adhering fabric permanently attached to the back of them.

Figure 19:
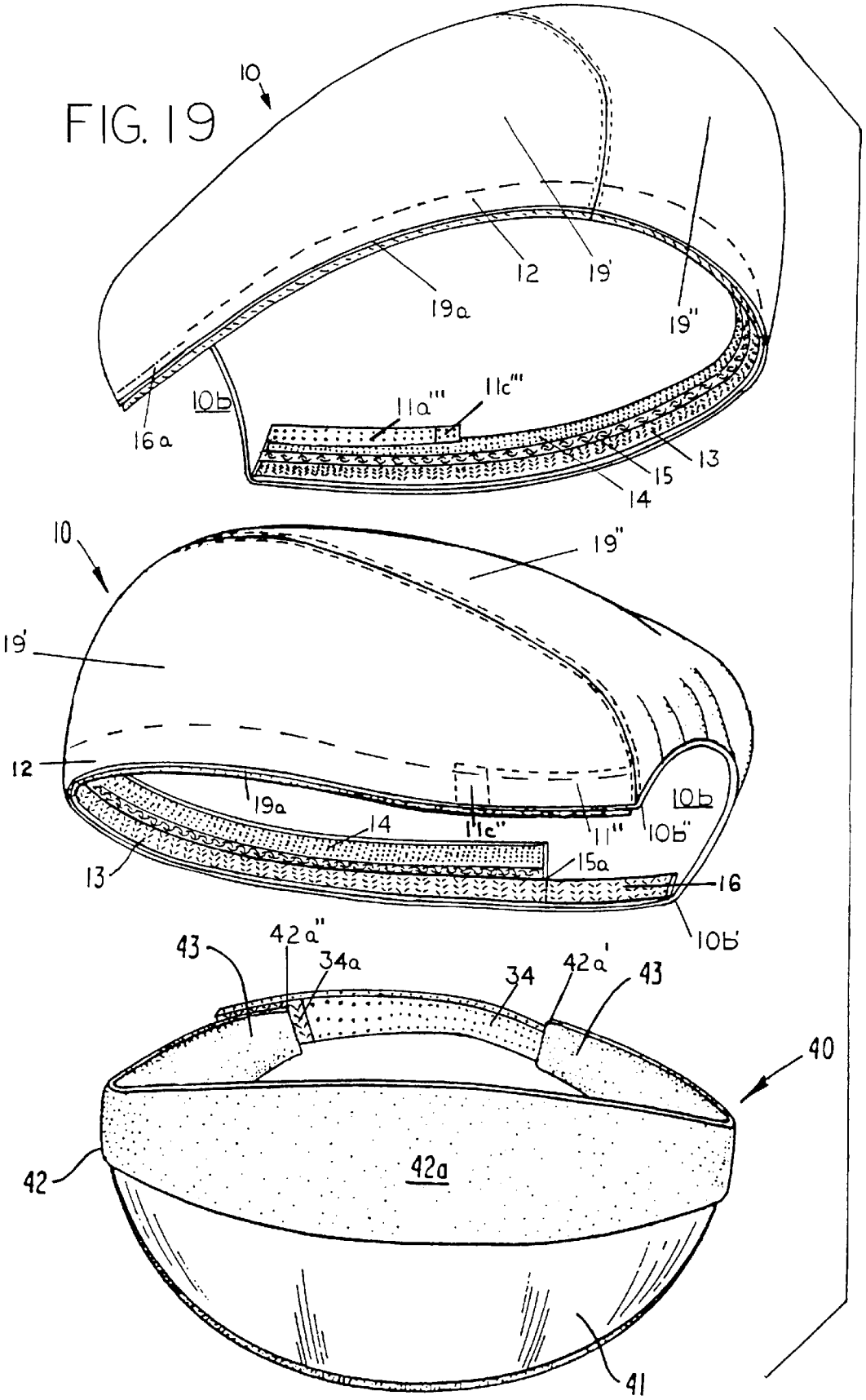
FIG. 19 is a perspective view of a second embodiment of the modular cap assembly of the present invention.

FIG. 19 illustrates a third preferred embodiment of the present invention. The difference between the first, second and third embodiments of the modular cap assembly of the present invention is the back closure mechanism in the crown component 10 and the back closure mechanism in the visored headband component 40. The remainder of the invention is the same in the first three embodiments. The back closures in the crown and the visor provide that the circumference of each component is adjustable to fit a range of head sizes. In the third preferred embodiment, the fold-down sweatband 12 of the crown 10 has an extended section of material made of velcro hook-adhering material on both the inside face 11" and the opposite face 11*a*"'. A section of velcro hook 11*c*" is fixedly attached to the inside face 11" of the extended section at the free end. The extended section of velcro hook-adhering material 11" and 11*a*'" is folded back under the crown and placed on top of the fold-down sweatband 14 where it is selectively attached to the loop portion 14 of the fold-down sweatband 12 by the velcro loop-adhering material 11*c*" so that it does not extend beyond left back opening 10*b*" and does not show in the arched opening 10*b* at the rear portion of crown component 10. The outside face of the extended section of material without the velcro hook sewn onto it, 11*a*'", is facing the wearer's head. As in the first embodiment, the placement of the extended section of material with inside face 11" and opposite face 11*a*'" from the fold-down sweatband 12 and the start of the fold-down sweatband 15*a* can be reversed.

Second, the back closure of the visor in the third preferred embodiment consists of an extended section of material with both the inside face 34 and the opposite face 34' made of velcro hook-adhering fabric. The back closure is fixedly attached at the left end 42*a*' of the forehead portion 42. This extended section of material has a section of velcro loop-adhering fabric 34*a* permanently attached to the free end of it on the inside face 34 which can be selectively attached to the velcro hook-engaging material in the forehead portion 42 at the end 42*a*" forming the back closure of the visor. As in the first and second embodiments, the directions of the attachment of the extended section of material can be reversed. In this embodiment, the permanent attachment of the crown back closure and the permanent attachment of the visor back closure are on the same side of the back opening so that they can be assembled to look like a double strap closure as shown in FIG. 22.

Figure 20:
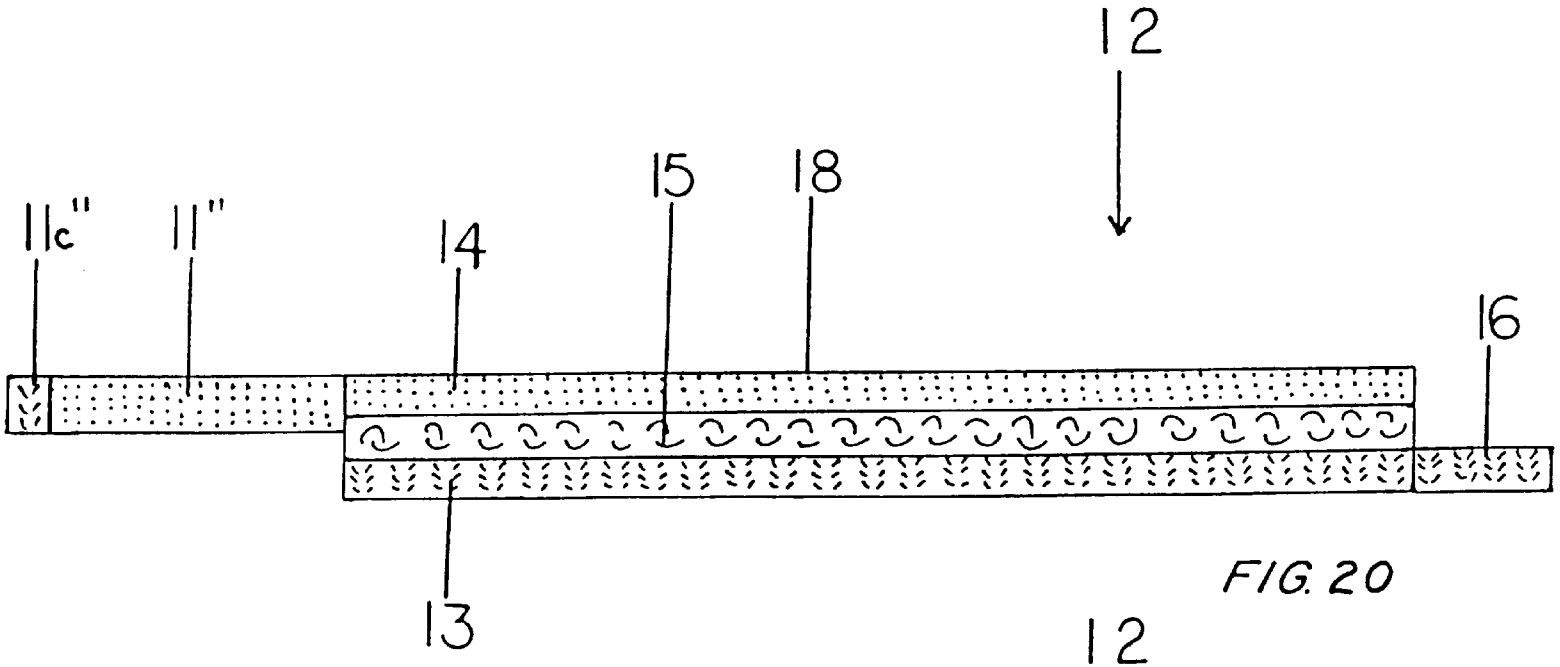
FIG. 20 is a detailed view of the side of the fold-down sweatband facing the visor in the second embodiment of the modular cap.
Figure 21:
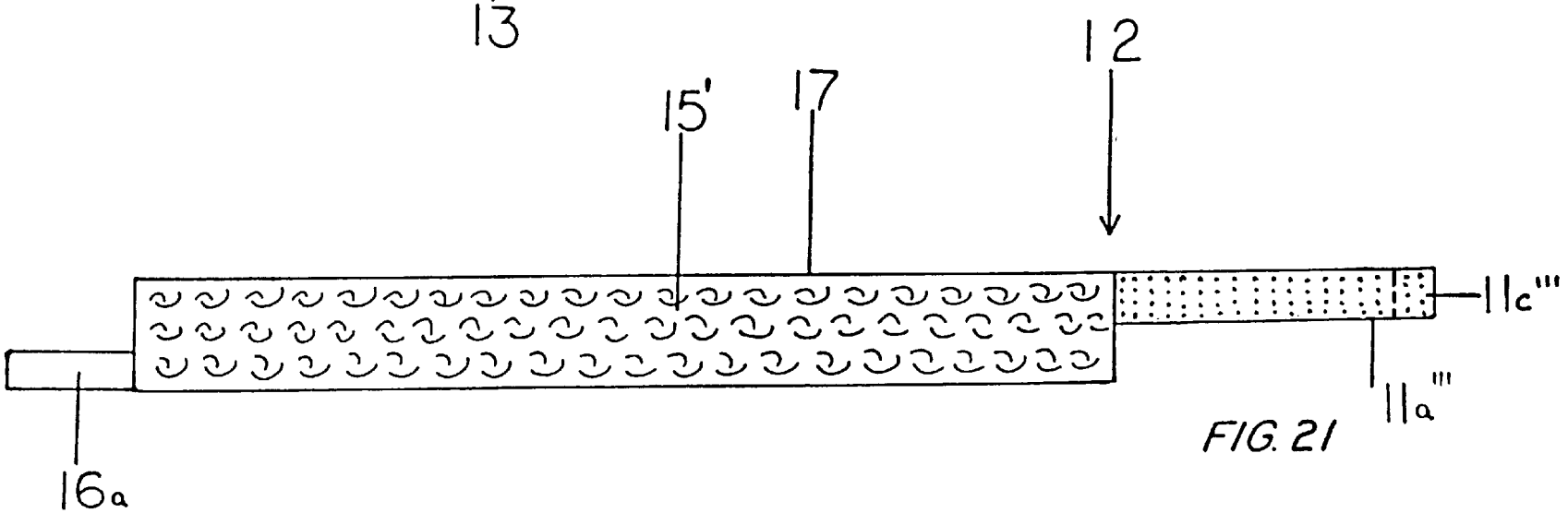
FIG. 21 is a detailed view of the side of the fold-down sweatband facing the crown in the second embodiment of the modular cap.

As shown in FIGS. 20 and 21, the fold-down sweatband 12 of the third embodiment has a first end with an inside face 11" made of velcro hook-adhering material with a section of velcro loop-adhering material 11*c*" fixedly attached to its free end. The second end 16 is an extension of the hook material 13 fixedly attached at the bottom of the inner surface 18 of the fold-down sweatband 12. The outer surface 17 is composed of the fabric 15' that faces the inside of the crown. The inner surface 18 is the side of the fabric 15 onto which the velcro hook 13 and the velcro loop 14 are fixedly attached, with a section of the velcro hook 13 extending to form end 16.

Figure 22:
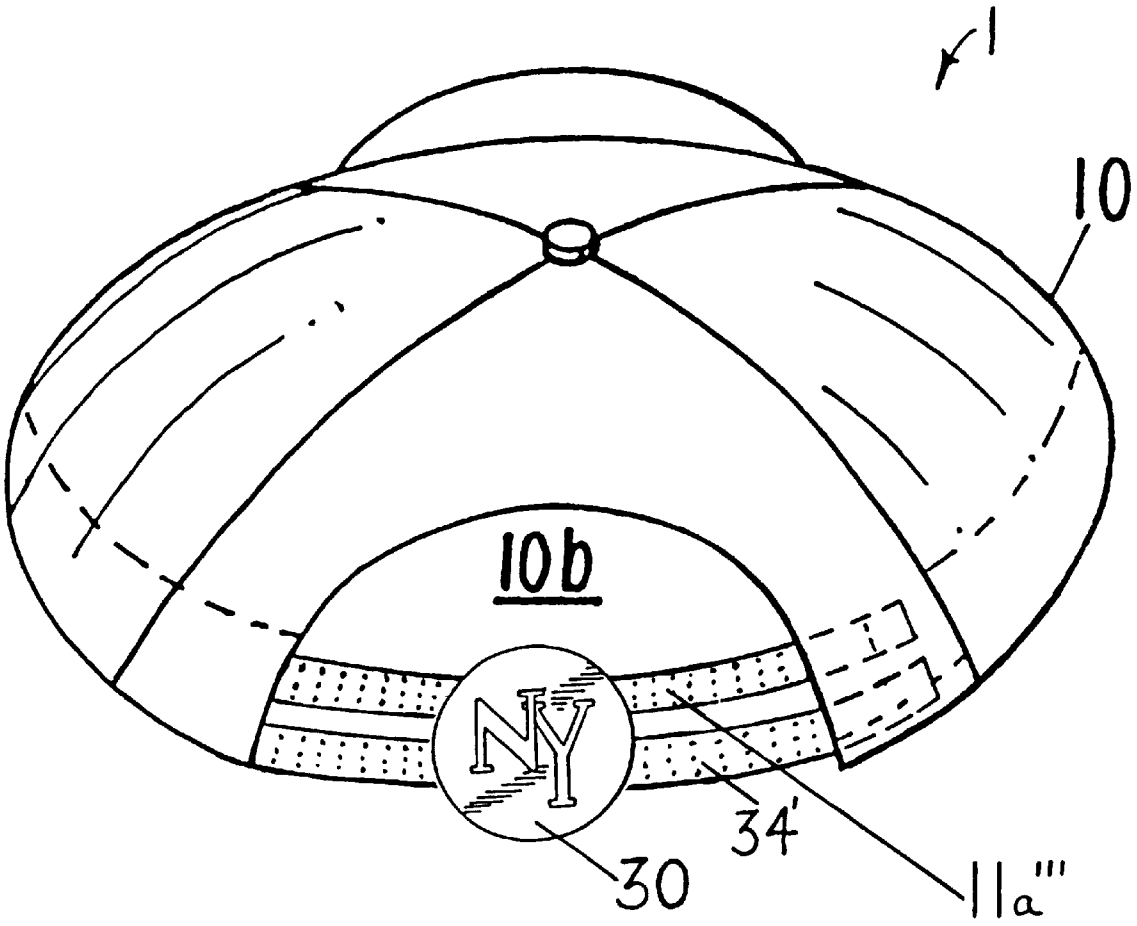
FIG. 22 is a rear view of the second embodiment of the modular cap in which both the back closure of the crown and the back closure of the visor are assembled over the back opening of the cap unit and a selectively attachable logo is displayed on the outward face of both back closures.

FIG. 22 is a rear view of the third embodiment of the modular cap of the present invention that shows the assembly of the selectively attachable logo 30 with front face 30 on the opposite face of the back strap 34' of the visor and the opposite face of the extended velcro hook-adhering material 11*a*'" of the crown. The back face 31 of the selectively attachable logo is made of velcro hook that selectively attaches to the velcro hook-adhering material on the opposite face of back strap 34' and the opposite face of crown strap 11*a*'". Selectively attachable pocket 90 can also be displayed in the same manner.

Figure 23:
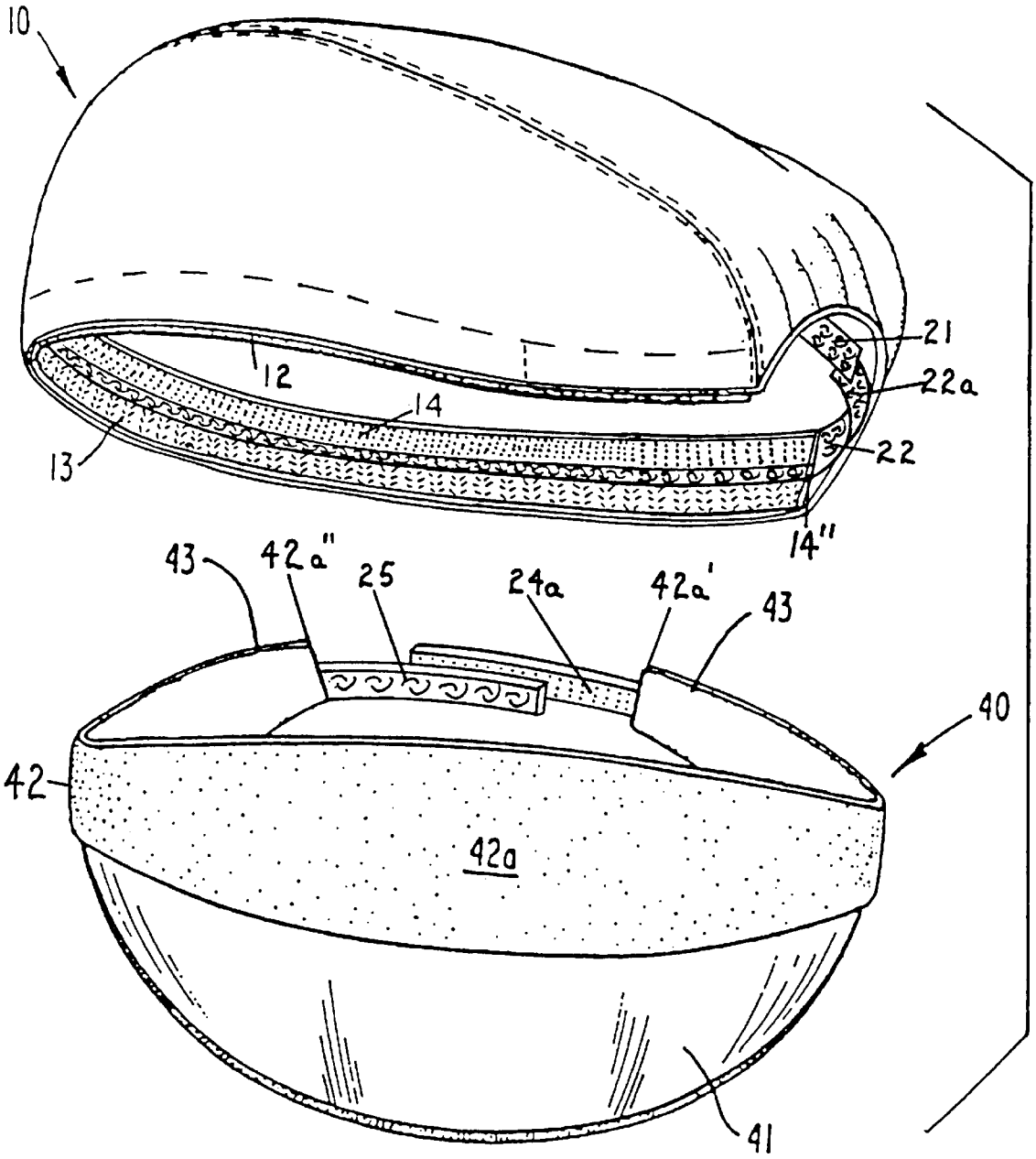
FIG. 23 is a perspective view of a fourth embodiment of the modular cap assembly of the present invention.

FIG. 23 illustrates a fourth preferred embodiment of a modular cap assembly constructed in accordance with the teachings of the present disclosure. The difference between the first, second, third and fourth embodiments of the modular cap assembly of the present invention is the back closure mechanism in the crown component 10 and the back closure mechanism in the visored headband component 40. The remainder of the invention is the same in the first four embodiments. The back closures in the crown and the visor provide that the circumference of each component is adjustable to fit a range of head sizes. In the fourth preferred embodiment of the crown, one end 14' of the fold-down sweatband 12 of the crown 10 has an extended section made of velcro hook-adhering material 21*a* on the inside face and fabric on the opposite face 21. The other end 14" has an extended section made of velcro loop-adhering material 22*a* on the inside face and fabric 22 on the opposite face.

In the fourth preferred embodiment of the visor a back strap with fabric on the opposite face 25 facing the head of the wearer and inside face 25*a* with velcro loop-adhering material fixedly attached to it is permanently attached at the right end 42*a*" of the forehead portion 42 of the visor. A second back strap with velcro hook-adhering material on the inside face 24*a* facing the head of the wearer and opposite face 24 made of fabric facing away from the head of the wearer is permanently attached at the left end 42*a*' of the forehead portion 42 of the visor. The strap of velcro hook-adhering material 24*a* selectively adheres to the velcro loop-adhering material on the opposite face 25*a* of the other back strap.

Figure 24:
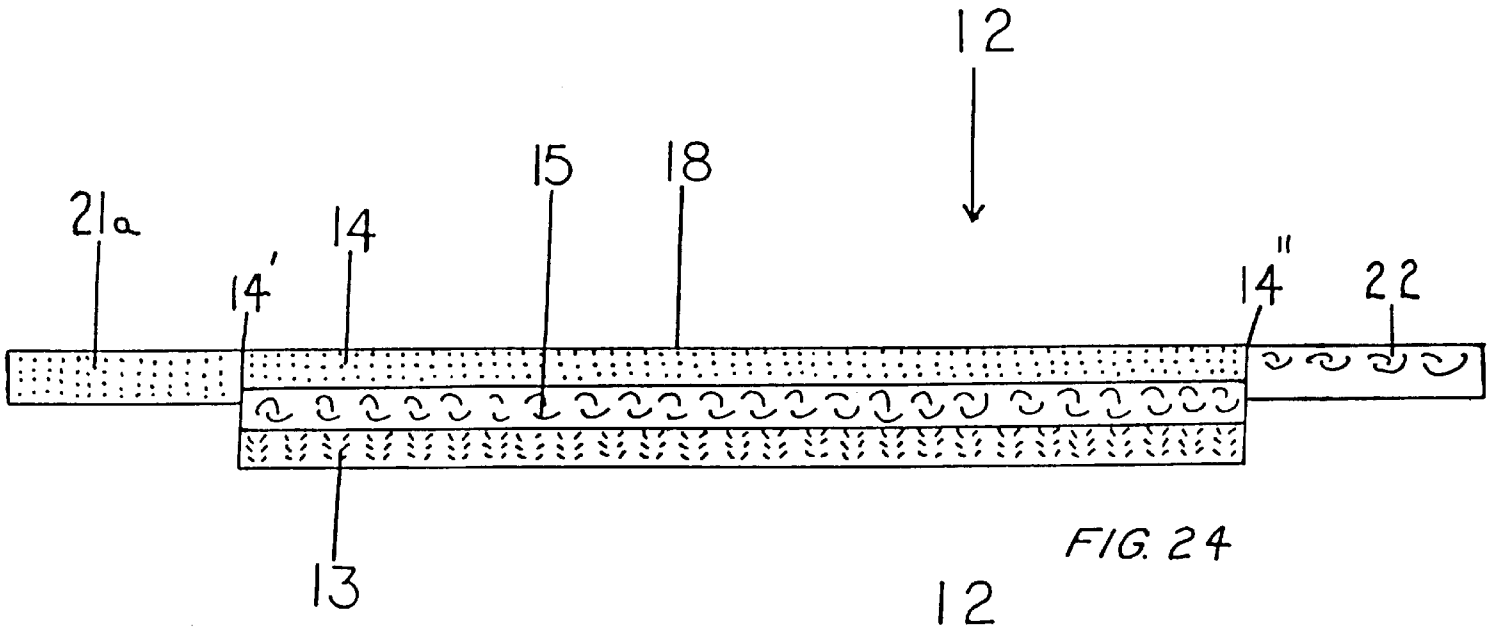
FIG. 24 is a detailed view of the side of the fold-down sweatband facing the visor in the fourth embodiment of the modular cap.
Figure 25:
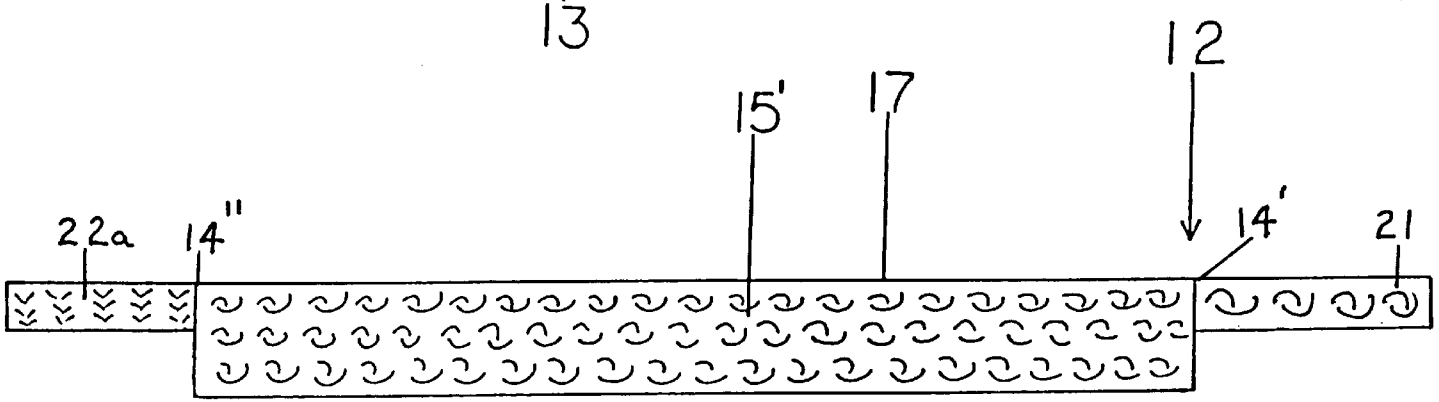
FIG. 25 is a detailed view of the side of the fold-down sweatband facing the crown in the fourth embodiment of the modular cap.

As shown in FIGS. 24 and 25, the fold-down sweatband 12 of the fourth embodiment has a first end with velcro hook-adhering material fixedly attached to the inside face 21*a* and fabric on the opposite face 21. The second end has velcro loop-adhering material fixedly attached to the inside face 22*a* and fabric on the opposite face 22. The inside face 21*a* and the inside face 22*a* of the ends are selectively attachable to each other.

Figure 26:
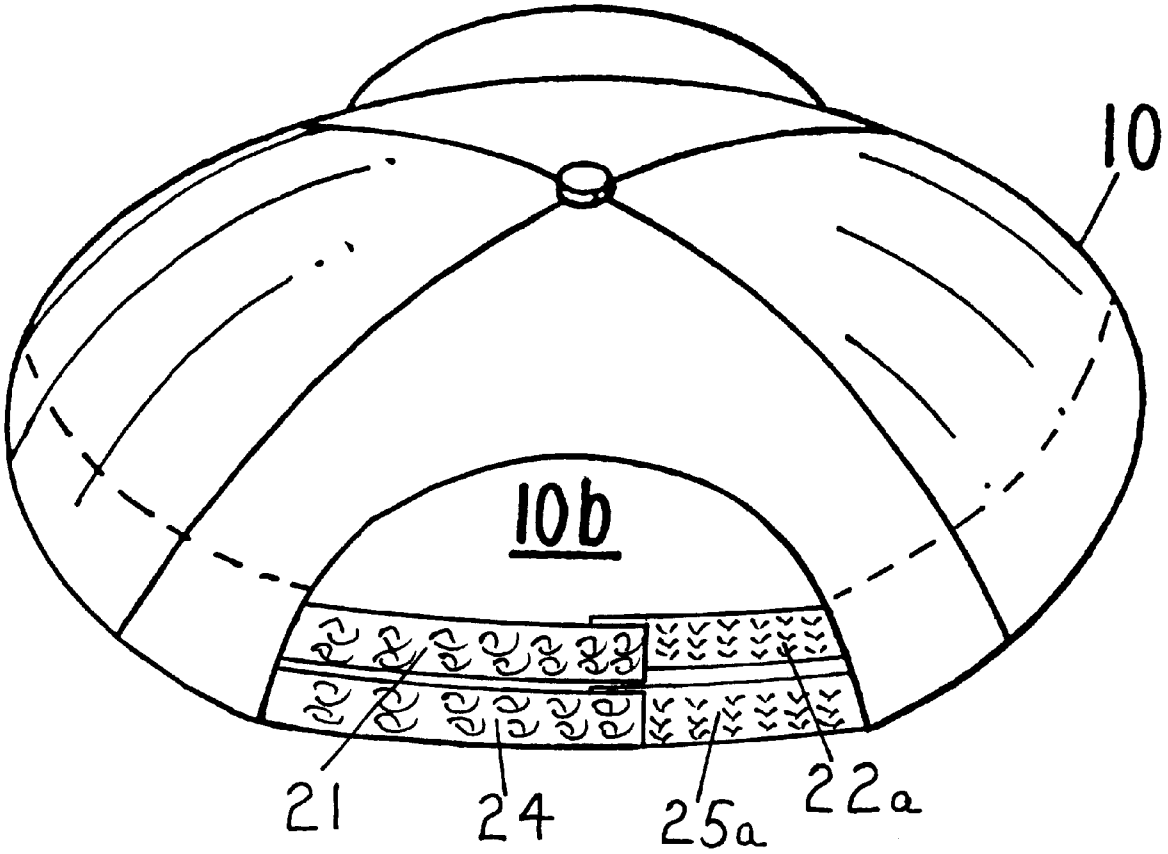
FIG. 26 is a rear view of a fourth embodiment of the modular cap assembly of the present invention.

FIG. 26 is a rear view of the fourth embodiment with the crown assembled over the visor showing the extensions of the fold-down sweatband 21 and 22*a* and the back attachment straps of the visor 24 and 25*a* assembled as double tabs over the back opening 10*b* in such a manner that the extended sections of the fold-down sweatband 21 and 22*a* mirror the attachment of the back straps of the visor 24 and 25*a*. In this embodiment, crown back closure tabs 21 and 22*a* can also be folded back inside the crown and the visor so that they do not show in back opening 10*b*.

Figure 27:
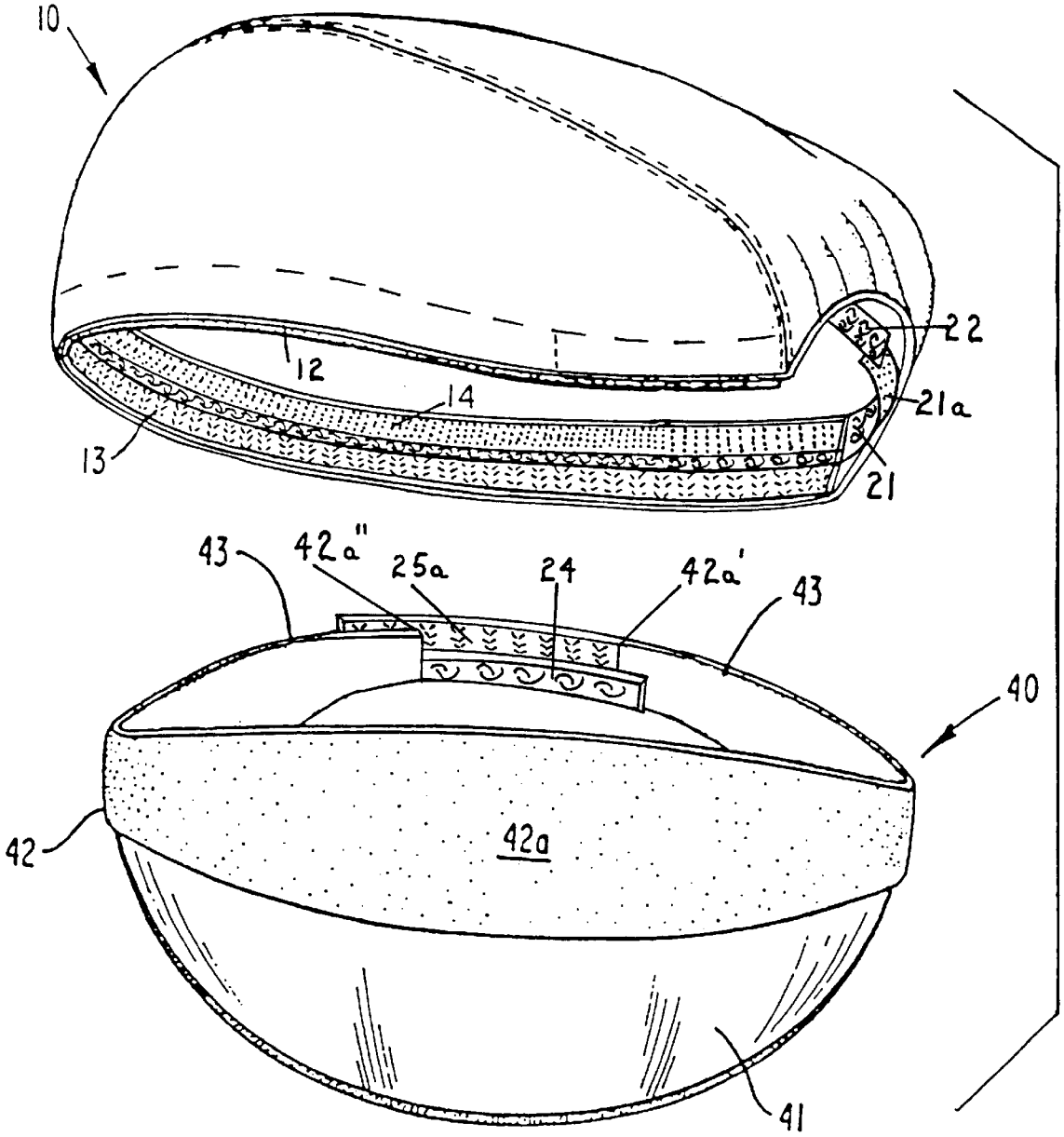
FIG. 27 is a perspective view of a fifth embodiment of the modular cap assembly of the present invention.

FIG. 27 illustrates a fifth preferred embodiment of a modular cap assembly constructed in accordance with the teachings of the present disclosure. In the fifth preferred embodiment the positions of the back straps of the visor and the crown in the fourth preferred embodiment are reversed. As a result, the back strap of the visor with velcro loop-adhering hook material 25*a* faces the head of the wearer and can selectively adhere to the velcro hook-adhering fabric on the forehead portion 42 of the visor when the circumference of the visor must be small because the wearer has a small head. The back closures in the crown and the visor provide that the circumference of each component is adjustable to fit a range of head sizes.

Figure 28:
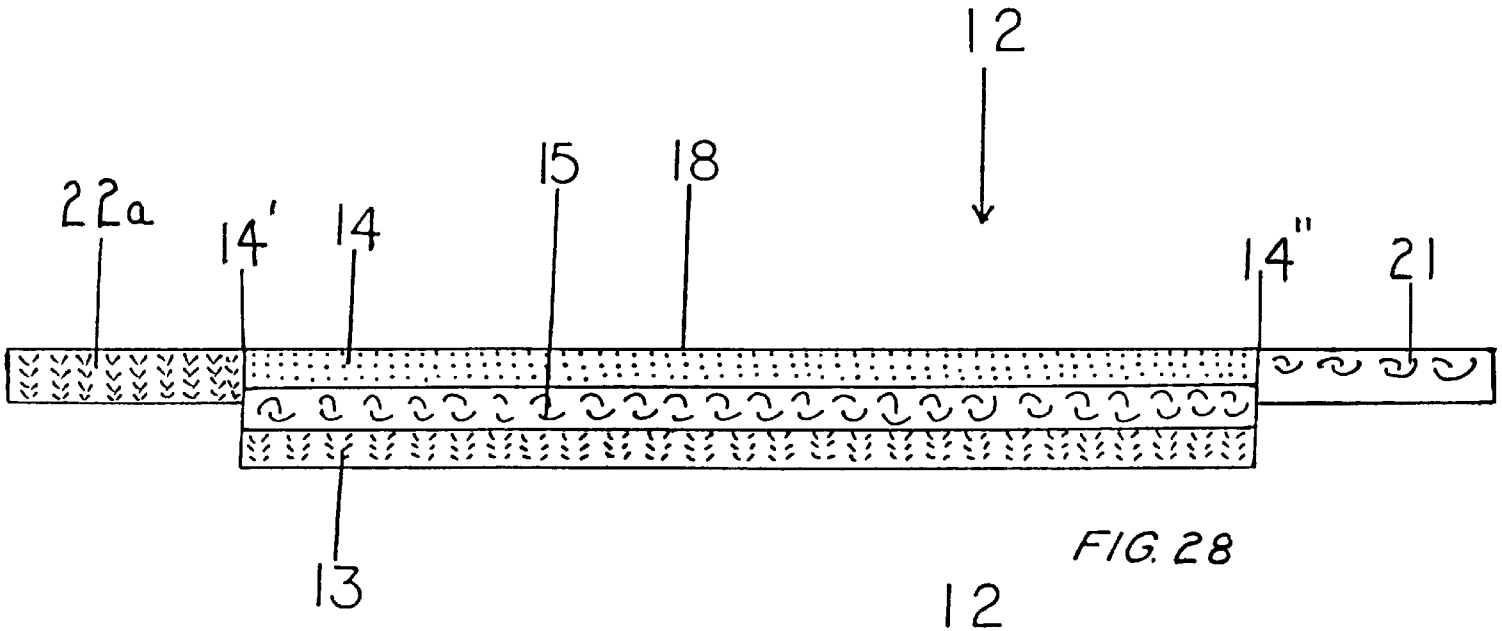
FIG. 28 is a detailed view of the side of the fold-down sweatband facing the visor in the fifth embodiment of the modular cap.
Figure 29:
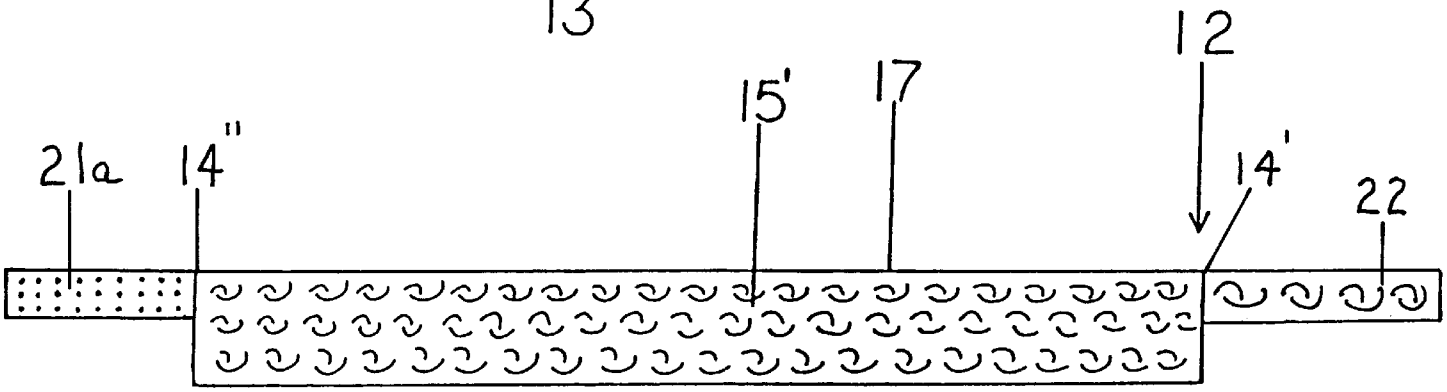
FIG. 29 is a detailed view of the side of the fold-down sweatband facing the crown in the fifth embodiment of the modular cap.

Details of the fold-down sweatband of the fifth embodiment of the crown are shown in FIG. 28 and FIG. 29.

Figure 30:
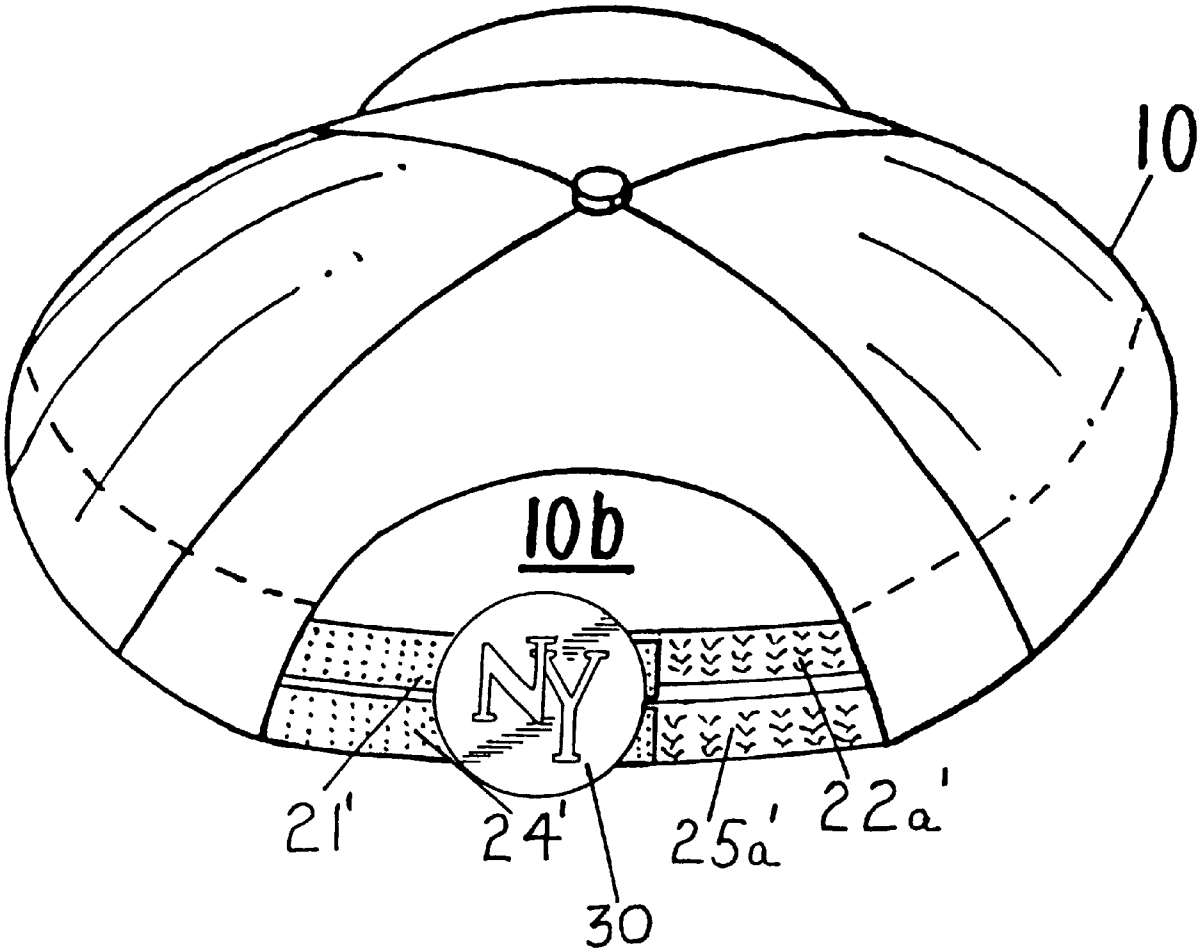
FIG. 30 is a rear view of a sixth embodiment of the modular cap assembly of the present invention.

A sixth preferred embodiment is the same as the fourth preferred embodiment except that the opposite face of the velcro hook-adhering material of the back tab 21*a* and the opposite face of the velcro loop-adhering material 22*a* in the fold-down sweatband of the crown, and the opposite face of the velcro hook-adhering material 24*a* of the back tab and the opposite face of velcro loop-adhering material 25*a* of the back tab of the visor is made of velcro hook-engaging material, becoming back tabs with sides 21' and 22' in the crown and back tabs with sides 24' and 25' in the visor. The back closures in the crown and the visor provide that the circumference of each component is adjustable to fit a range of head sizes. FIG. 30 shows a rear view of the sixth embodiment that displays detachable logo 30 on the back tabs 21' and 24'. Detachable pocket 90 can be selectively displayed in the same manner.

Figure 31:
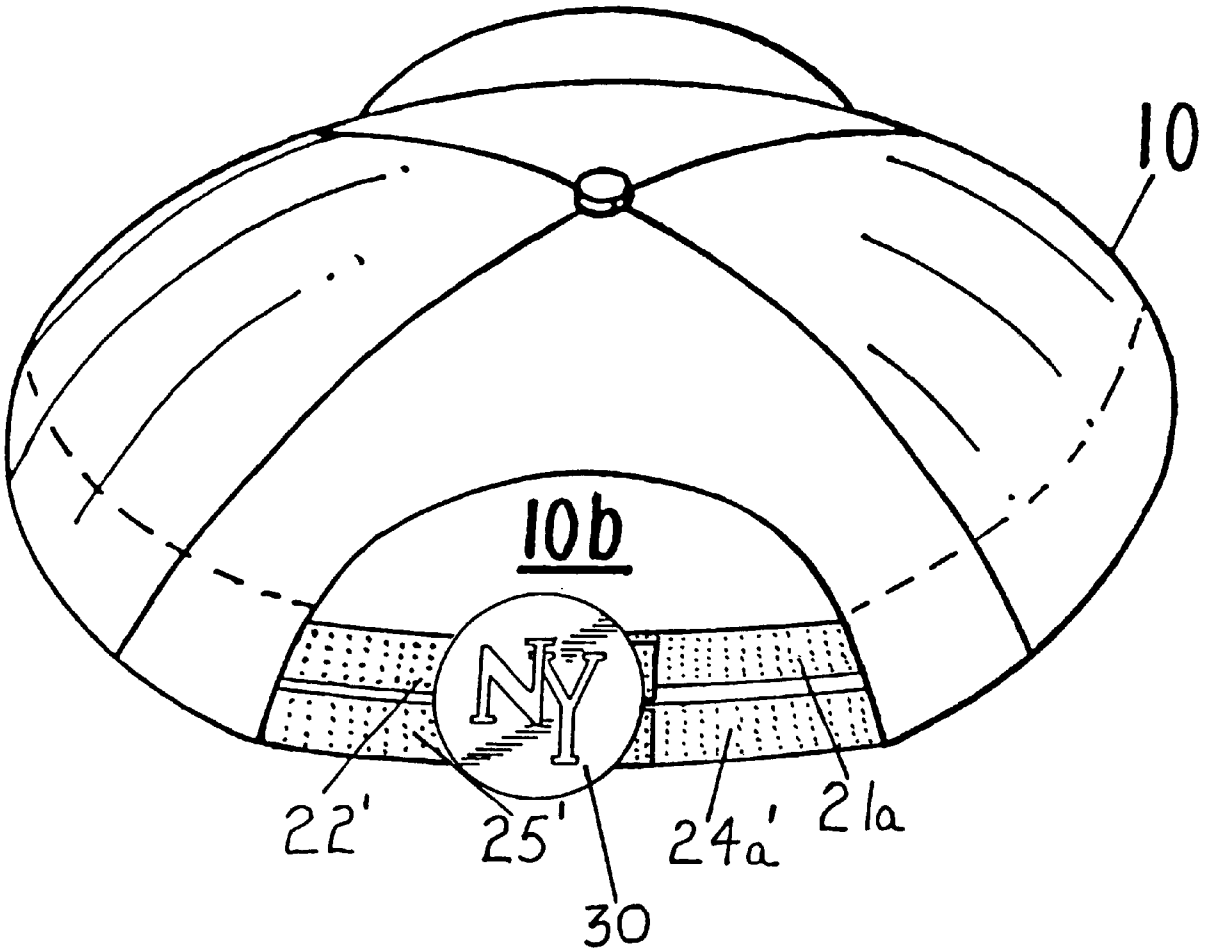
FIG. 31 is a rear view of a seventh embodiment of the modular cap assembly of the present invention.

A seventh preferred embodiment is the same as the fifth preferred embodiment except that the opposite face of the velcro hook-adhering material 21*a* of the back tab and the opposite face of the velcro loop-engaging material 22*a* of the back tab in the fold-down sweatband of the crown, and the opposite face 24 of the velcro hook-adhering material in the back tab and the opposite face of the velcro loop-adhering material 25*a* in the back tab of the visor is made of velcro hook-engaging material, becoming back tabs 22' and 21*a* in the crown and 25' and 24*a'* in the visor. The back closures in the crown and the visor provide that the circumference of each component is adjustable to fit a range of head sizes. FIG. 31 shows a rear view of the seventh embodiment that display detachable logo 30 on the back tabs 22' and 25'. Detachable pocket 90 can be selectively displayed in the same manner. As in the fifth embodiment, the back strap of the visor with velcro loop-adhering hook material 25*a* faces the head of the wearer and can selectively adhere to the velcro hook-adhering fabric on the forehead portion 42 of the visor when the circumference of the visor must be small because the wearer has a small head.

Figure 32:
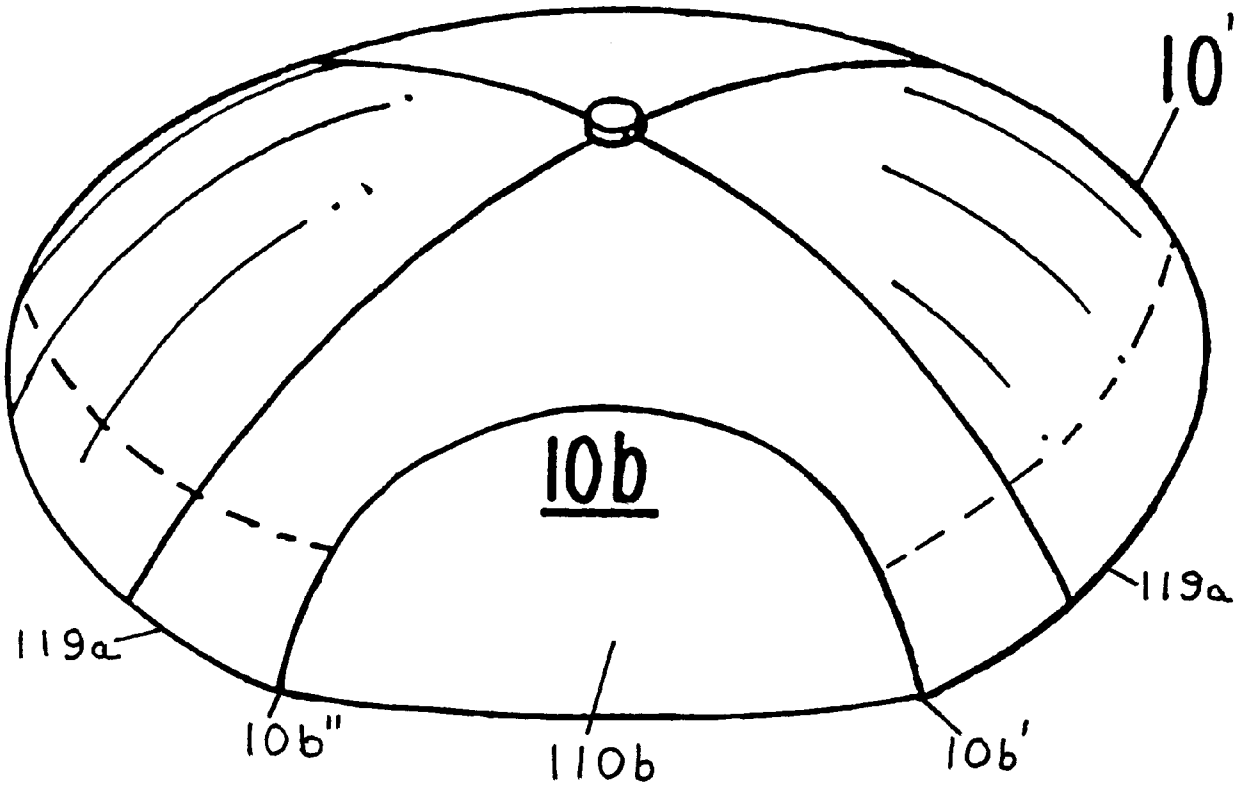
FIG. 32 is a rear view of an eighth embodiment of the modular cap assembly of the present invention.

FIG. 32 shows a rear view of an eighth preferred embodiment of the crown 10' of the present invention in which the back opening 10*b* is permanently covered 110*b* while still providing for a fit for a range of head sizes. The opening 10*b* at the back of the crown 10 can be covered 110*b* with any type of fabric with a section of elastic or other stretchable material fixedly adhered to the bottom edge of it forming crown 10' that provides that the circumference of the crown component is adjustable to fit a range of head sizes. In addition, the opening 10*b* at the back of the crown 10 can be covered 110*b* with any type of stretchable material fixedly adhered to it forming crown 10' that provides a fit for a range of head sizes. Fold-down sweatband 212' extends around the circumference of lower edge 119*a'* of crown 10' until it reaches point 10*b"* on the left back side and 10*b'* on the right back side of the crown 10'. The back section of the lower edge 119*a'* between 10*b'* and 10*b"* has no fold-down sweatband attached to it. As noted in previous embodiments, the invention is not limited to a particular crown or bill shape or material and in fact works with any number of crown and bill shapes, conventional materials and relative rigidity, including very flexible or "floppy" crowns as well as bills that flip up. Crown 10' can be worn with any of the visors of the modular cap assembly of the present invention. Crown 10' can also be worn separately as a brimless cap or "beanie". Crown 10' can be worn with any of the neck curtains or ear flaps of the modular cap assembly, whether assembled over any of the visors as a cap unit or worn separately as a brimless cap or "beanie".

Figure 33:
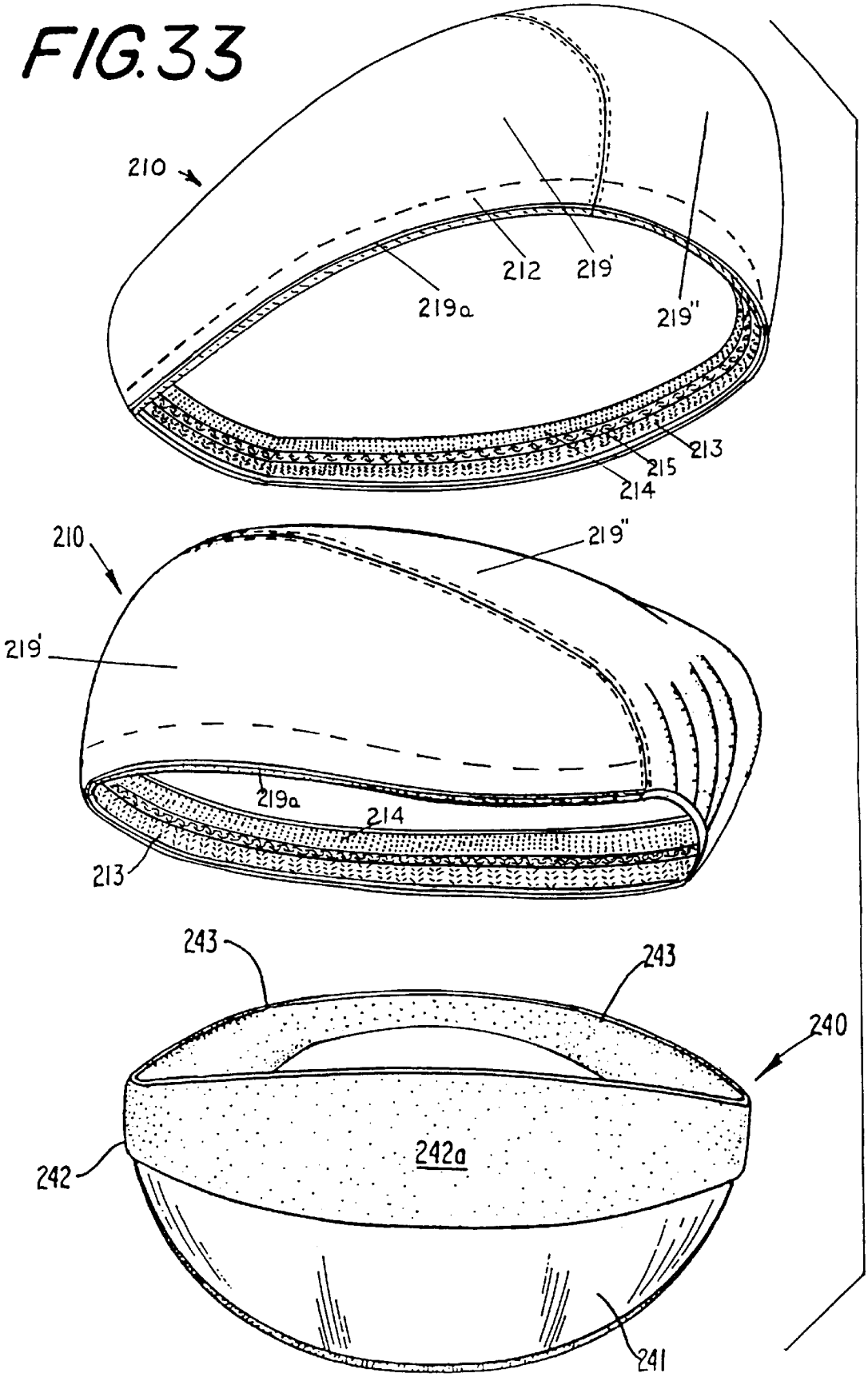
FIG. 33 is a perspective view of an eighth embodiment of the modular cap assembly of the present invention.
Figure 34:
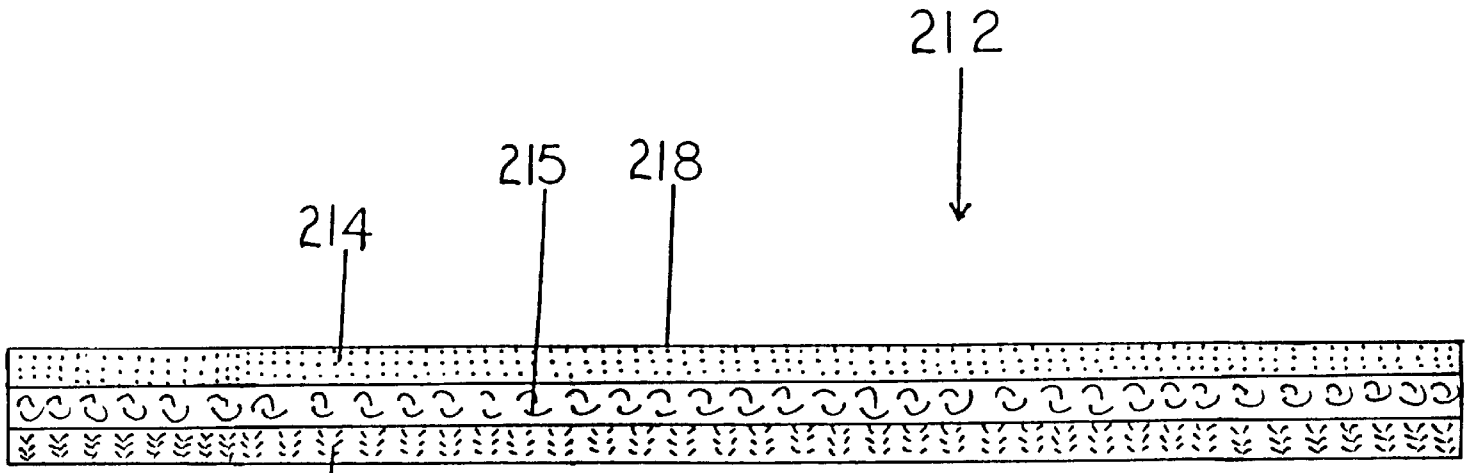
FIG. 34 is a detailed view of the side of the fold-down sweatband facing the visor in the eighth preferred embodiment of the modular cap assembly of the present invention.
Figure 35:
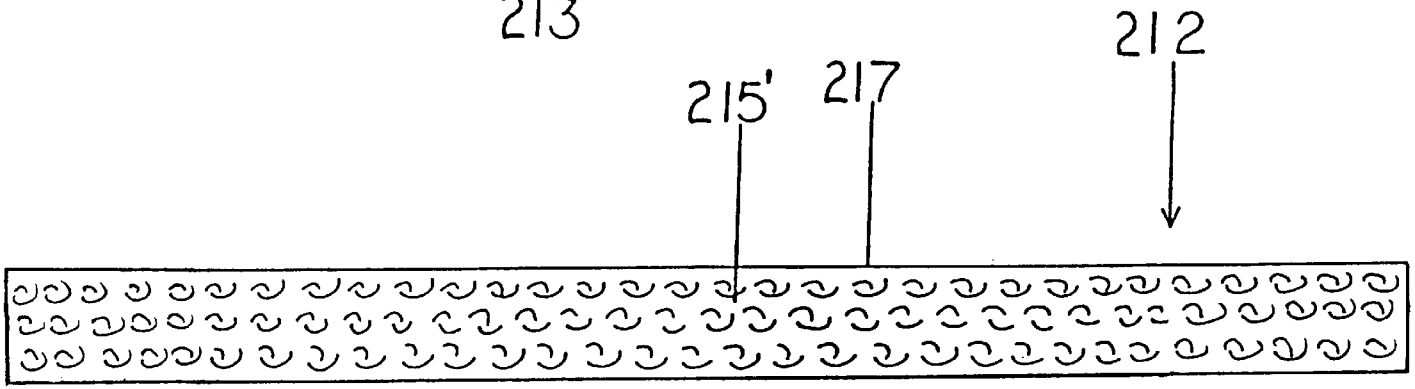
FIG. 35 is a detailed view of the side of the fold-down sweatband facing the crown in the eighth preferred embodiment of the modular cap assembly of the present invention.

A ninth preferred embodiment in FIG. 33 shows a fitted detachable crown 210 and a fitted detachable visor 240. To accommodate different head sizes, the fitted detachable crown 210 and the fitted detachable visor 240 of the ninth preferred embodiment must be made in different sizes. With reference to the ninth preferred embodiment of the invention as shown in FIG. 33, crown 210 displays a specific type of crown that includes side crown portions 219' and a central crown portion 219", although it should be noted that the invention is not limited to a particular crown or bill shape or material and in fact works with any number of crown and bill shapes, conventional materials and relative rigidity, including very flexible or "floppy" crowns as well as bills that flip up. In the ninth preferred embodiment, there is no back opening 10*b* in the crown 210. Center crown section 219" extends down to back edge 219*a*. Fold-down sweatband 212 as detailed in FIG. 34 and 35 extends around the entire circumference of lower edge 219*a* of crown 210. The crown component 210 has a circumference of a specific length. To fit a range of head sizes, it must be made in a range of sizes with a range of circumferences for crown component 210.

In the ninth preferred embodiment, there is also no back opening in visored headband component 240. Visored headband component 240 includes a bill portion 241, a forehead portion 242, and a sweatband/lining portion 243. Bill portion 241 is preferably formed from a plastic material and covered with fabric. Forehead portion 242 is formed having a forward face 242*a*, also known as the billboard area of the visor, comprising hook and loop tape hook portion-engaging material. In the ninth preferred embodiment, the forehead portion 242 is fixedly attached at the lower edge thereof to the bill portion 241 and extends beyond each side of the bill portion 241 until the point where each side is fixedly attached to the other to fit the circumference of the head. As with the fitted crown 210, the fitted visored headband 240 has a circumference of a specific length. To fit a range of head sizes, it must be made in a range of sizes with a range of circumferences in the visored headband 240. As with embodiments one through seven, 242*a* provides an area for display of detachable insignias 30 and detachable pockets 90 with velcro hook fixedly attached to the back of them. In addition, detachable neck curtains 28 or 328, or detachable ear flaps 30' or 330', can be selectively attached to the side portions 242.

Figure 36:
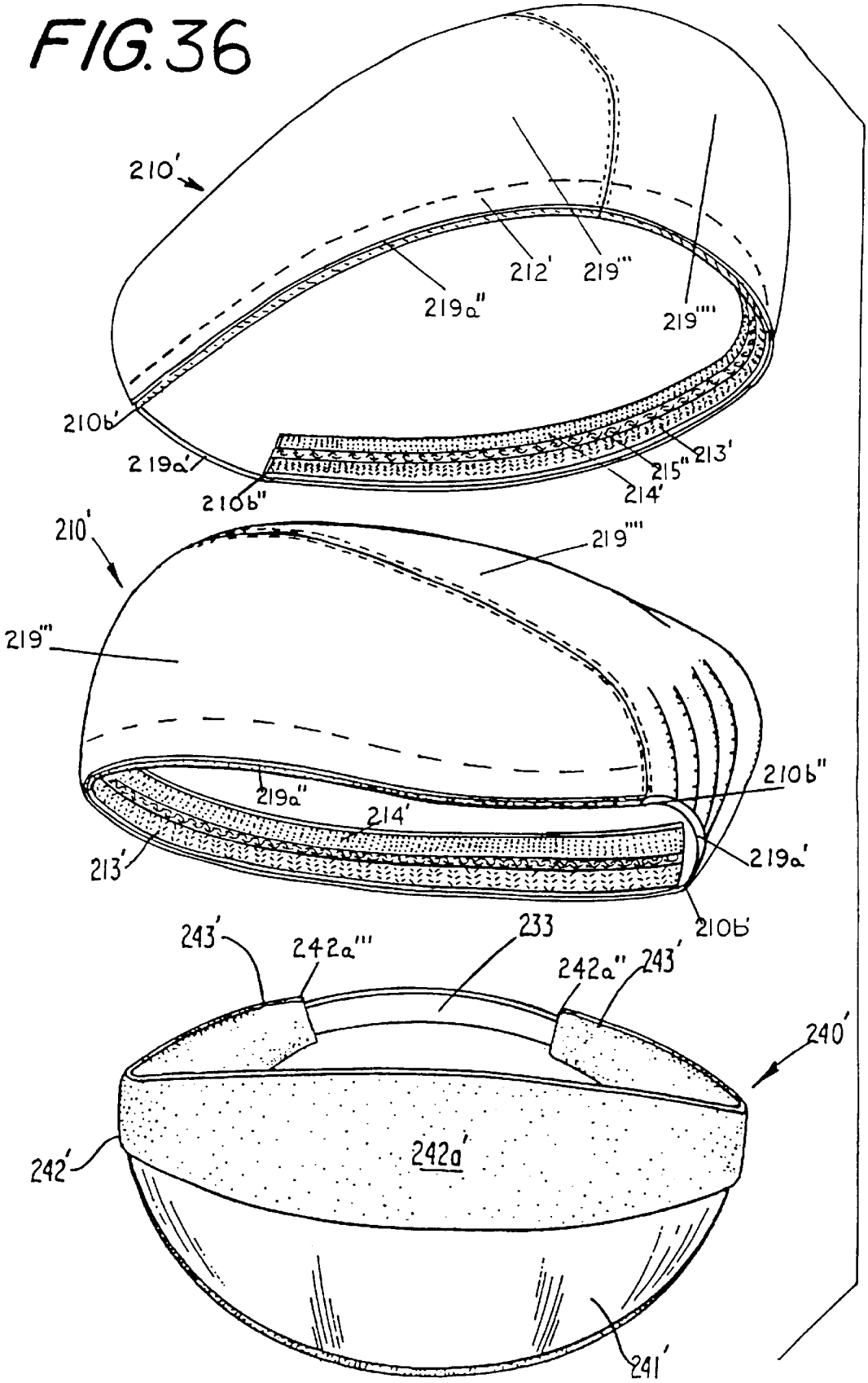
FIG. 36 is a perspective view of a ninth preferred embodiment of the modular cap assembly.

FIG. 36 is a perspective view of a tenth preferred embodiment that shows a fitted detachable crown 210' and a fitted detachable visor 240'. The fitted crown component 210' and the fitted visor component 240' each have a circumference of a specific length. To fit a range of head sizes, fitted crown component 210' and fitted visor component 240' must be made in a range of sizes with a range of circumferences. The difference between the ninth preferred embodiment and the tenth preferred embodiment lies in the back of the crown and the back of the visor. In the tenth preferred embodiment of the crown 210', center crown section 219"" extends down to back edge 219*a'*. Fold-down sweatband 212' extends around the circumference of lower edge 219*a"* of crown 210' until it reaches point 210*b"* on the left back side and 210*b'* on the right back side of the crown 210'. The back section of the lower edge 219*a'* between 210*b'* and 210*b"* has no fold-down sweatband attached to it. As noted in previous embodiments, the invention is not limited to a particular crown or bill shape or material and in fact works with any number of crown and bill shapes, conventional materials and relative rigidity, including very flexible or "floppy" crowns as well as bills that flip up.

In the tenth preferred embodiment of the detachable visor, forehead portion 242' is fixedly attached at the lower edge thereof to the bill portion 241' and extends beyond each side of the bill portion 241' until the point were it reaches 242*a"* on the left side and 242*a'"* on the right side. A portion of material is permanently attached to both ends of forehead portion 242*a"* and 242*a'"* to form the back of the fitted detachable visor 233.

Figure 37:
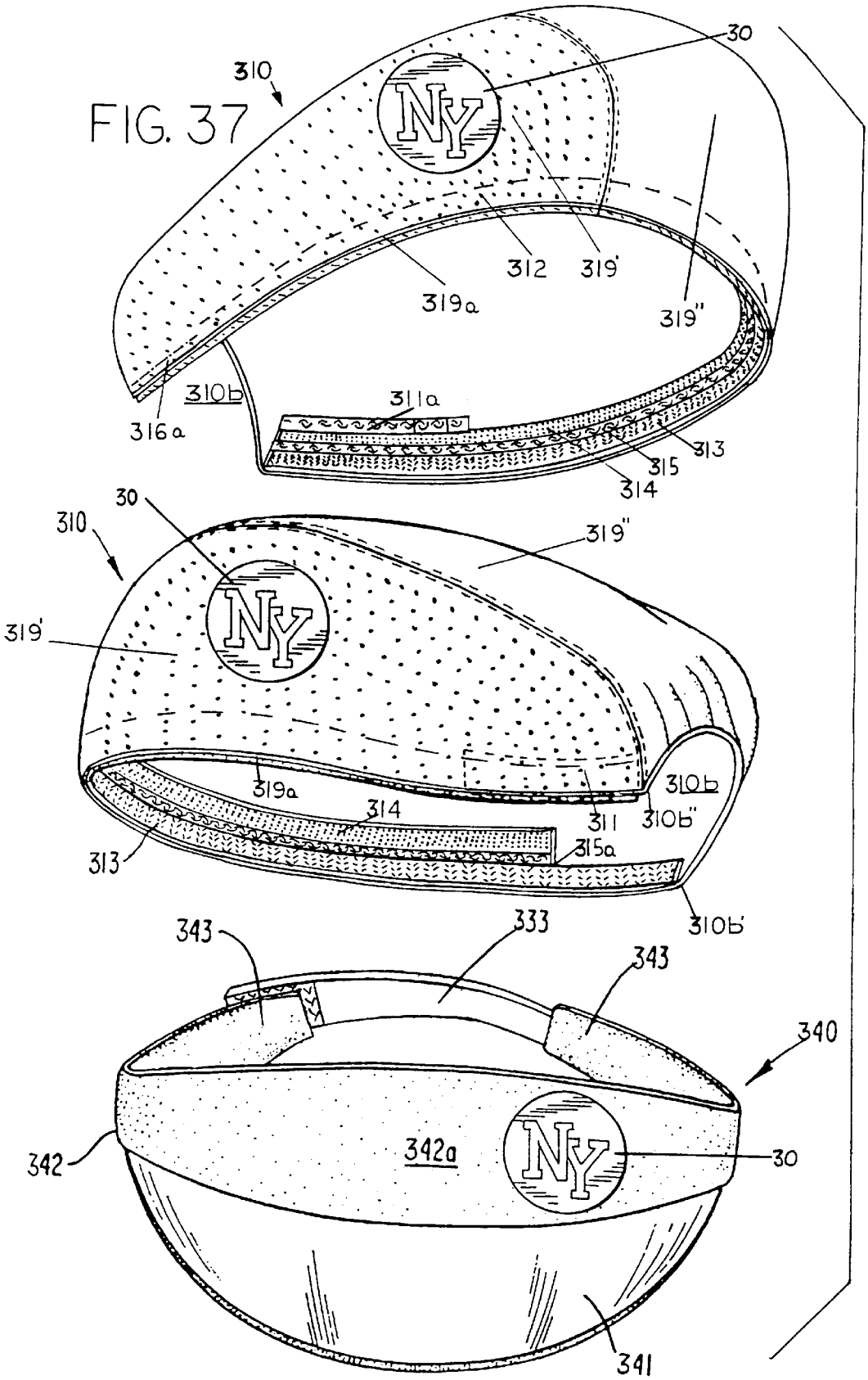
FIG. 37 is a perspective view of a tenth preferred embodiment of the modular cap assembly with at least one panel of the crown made of velcro adhering fabric to display selectively attachable logos and/or selectively attachable pockets, which can also be displayed on the billboard of the visor made of velcro hook-adhering fabric.

FIG. 37 is a perspective view of an eleventh preferred embodiment of the modular cap assembly with at least one panel of the crown 310 made of velcro hook-adhering fabric 319' to allow the display of selectively attachable insignias 30 and/or selectively attachable pockets 90, which can also be displayed on the billboard of the visor made of velcro hook-adhering fabric. The back closures of the crown 310 and the visor 340 in FIG. 37 are the same as those in the second embodiment. It should be understood, however, that the crowns of any of the embodiments of the modular cap of the present invention can be constructed with at least one panel made of velcro hook-adhering fabric.

Figure 38:
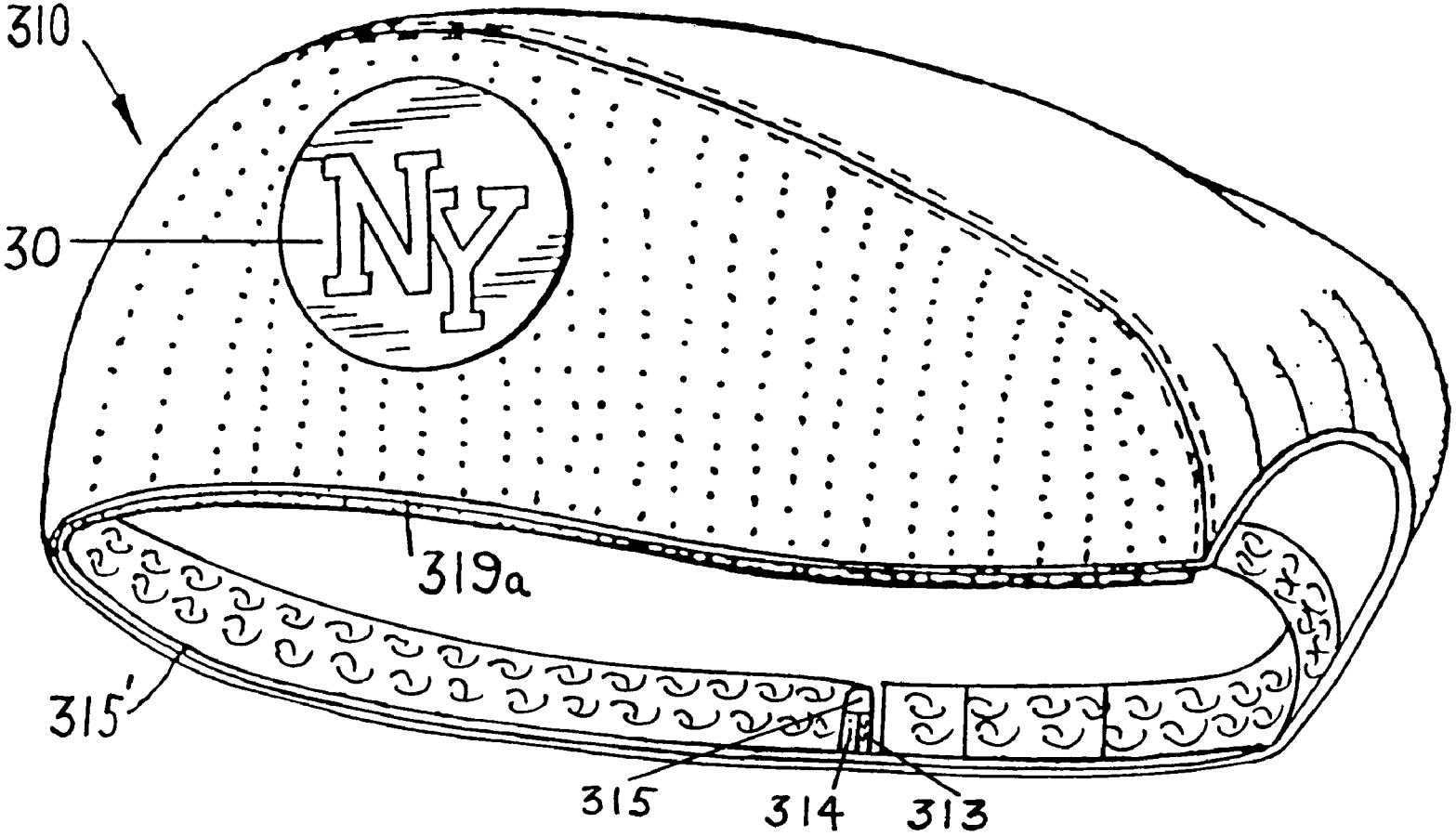
FIG. 38 is a view of the crown in the tenth preferred embodiment of the modular cap assembled as a brimless cap or "beanie".

FIG. 38 is a view of the crown 310 in the eleventh preferred embodiment of the modular cap with at least one panel of the crown made of velcro hook-adhering fabric in which the velcro loop 314 permanently affixed along the top of the fabric backing 315 of the sweatband is folded over the velcro hook 313 permanently affixed along the bottom of the fabric backing 315 so that the alternate side of the fabric backing 315' faces the wearer's head, and the back closure is opened over the back opening and attached to the velcro hook at the bottom of the inside of the crown so that the crown can be worn as a beanie cap. The crowns detailed in any of the embodiments of the modular cap of the present invention can be constructed with at least one panel made of velcro hook-adhering fabric and as a result can display detachable insignias 30 and/or detachable pockets 90 when assembled as a brimless cap or "beanie".

Figure 39:
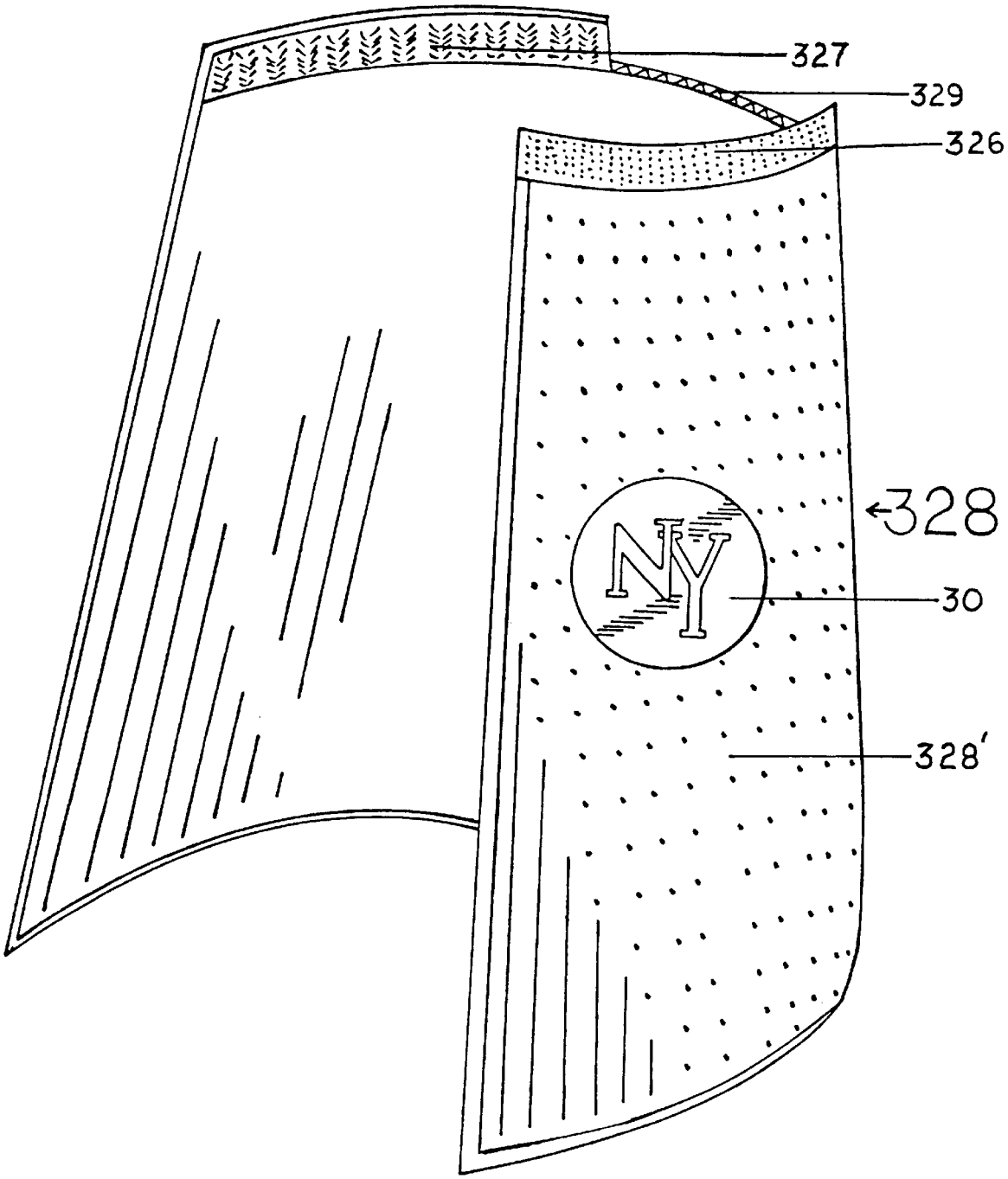
FIG. 39 is a detailed view of a selectively detachable neck curtain with an outside face made of velcro hook-adhering material displaying a detachable logo selectively attached to it.

FIG. 39 is a detailed view of a selectively detachable neck curtain 328 with an outside face 328' made of velcro hook-adhering material displaying a detachable logo 30 selectively attached to it. Selectively detachable pocket 90 can be displayed in a similar manner. Selectively detachable neck curtain 328 can be used with any of the embodiments of the modular cap of the present invention, whether assembled as a cap unit or worn separately as a brimless cap and as a visor.

Figure 40:
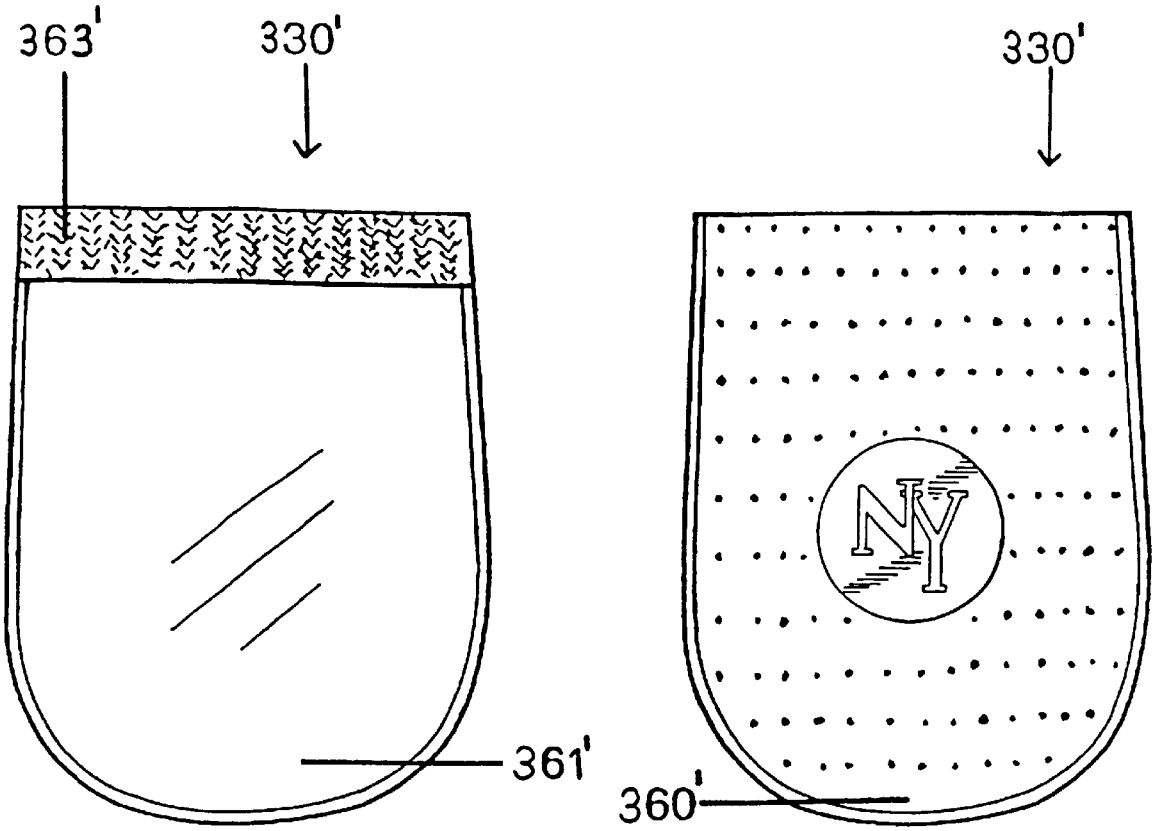
FIG. 40 is a detailed view of a selectively detachable ear flap having an outside face made of velcro hook-adhering material displaying a detachable logo selectively attached to it.

FIG. 40 is a detailed view of a selectively detachable ear flap 330' having an outside face 360' made of velcro hook-adhering material displaying a detachable logo 30 selectively attached to it. Selectively detachable pocket 90 can be displayed in a similar manner. Two selectively detachable ear flaps 330' can be used with any of the embodiments of the modular cap of the present invention, whether assembled a cap unit or worn as separately.

I claim:

1. A modular cap assembly comprising:

A crown component constructed of a plurality of flaccid material panels, the crown component including an inside, forward, and rear portions, said crown component having a circumference, a crown attachment means fixedly attached to the inside portion, wherein said crown attachment means includes a fold-down sweatband having a lower edge attached to said inside portion, the fold-down sweatband having mateable attachment means at the lower edge and at an opposite upper edge for mutual engagement thereof; and a visored component including a bill, forehead, front, rear, and lining portions, said forehead portion having a lower edge attached to said bill, the bill having sides, a top and a bottom, the forehead portion extending beyond the sides of the bill, said lining portion having a lower edge attached to said bill and disposed in the forehead portion along an inside thereof, said visored component having a circumference, said forehead portion having complementary mateable attachment means of said sweatband along an outside thereof; wherein said crown component is selectively attachable to the visor component through mutual engagement of said sweatband forehead portion mateable attachment means.

2. A modular cap assembly as in claim 1 wherein at least one panel of the crown component is made from one of hook and loop material.

3. A modular cap assembly as in claim 1 wherein the fold-down sweatband of the crown component is assembled in a manner allowing said crown component to be worn as a brimless cap.

4. A modular cap assembly as in claim 3 further comprising a selectively detachable attachment to said fold-down sweatband of said crown component.

5. A modular cap assembly as in claim 3 wherein a selectively detachable attachment on at least one crown panel is chosen from the following: an ornamental insignia with one of hook and loop material affixed thereto, and a pocket with one of hook and loop material affixed thereto.

6. A modular cap assembly as in claim 1 further comprising a selectively detachable attachment to said forward face of said forehead portion of said visored component.

7. A modular cap assembly as in claim 1 further comprising a selectively detachable attachment positioned between an outer surface of said forward face of said forehead portion of said visored component and said fold-down sweatband.

8. A modular cap assembly as in claim 1 wherein at least one detachable pocket with one of hook and loop material affixed thereto is attached to a complementary portion of the fold-down sweatband when said crown component is assembled over said visor component.

9. A modular cap assembly comprising: a crown component constructed of a plurality of flaccid material panels, the crown component including an inside, forward, and rear portions, a back fastening closure in said rear portion wherein a circumference of said crown component is adjustable to fit a range of head sizes, a crown attachment means fixedly attached to the inside portion, wherein said crown attachment means includes a fold-down sweatband having a lower edge attached to said inside portion, the fold-down sweatband having mateable attachment means at the lower edge and at an opposite upper edge for mutual engagement thereof; and a visored component including a bill, forehead, front, rear, and lining portion, said forehead portion having a lower edge attached to said bill, the bill having sides, a top and bottom, the forehead portion extending beyond the sides of the bill, said lining portion having a lower edge attached to said bill and disposed in the forehead portion along an inside thereof, said rear portion including a back fastening closure wherein the circumference of said visored component is adjustable to fit a range of head sizes, said forehead portion having complementary attachment means of said sweatband along an outside thereof; wherein said crown component is selectively attachable to the visor component through mutual engagement of said sweatband forehead portion mateable attachment means.

10. A modular cap assembly as in claim 9 wherein said back fastening closure is attached in an arched opening positioned in said rear portion of said crown component.

11. A modular cap assembly as in claim 10 wherein the back fastening closure comprises two straps adapted to be selectively positioned within the crown interior or extended across said arched opening.

12. A modular cap assembly as in claim 10 wherein the selectively detachable attachment to the back closure is chosen from one of the following: a logo with one of hook and loop material affixed thereto, a logo with a sleeve attachment mechanism affixed thereto, a pocket with one of hook and loop material affixed thereto, and a pocket with a sleeve attachment mechanism affixed thereto.

13. A modular cap assembly as in claim 10 wherein the back fastening closure comprises a single strap extending across said arched opening.

14. A modular cap assembly as in claim 9 wherein at least one panel of the crown component is made from one of hook and loop material.

15. A modular cap assembly as in claim 9 wherein the selectively detachable attachment on at least one crown panel is selected from the following: an ornamental insignia with one of hook and loop material affixed thereto, and a pocket with one of hook and loop material affixed thereto.

16. A modular cap assembly as in claim 9 wherein the fold-down sweatband of the crown component is assembled in a manner allowing said crown component to be worn as a brimless cap.

17. A modular cap assembly as in claim 16 further comprising a selectively detachable attachment to said fold-down sweatband of said crown component.

18. A modular cap assembly as in claim 9 further comprising a selectively detachable attachment to said forward face of said visored component.

19. A modular cap assembly as in claim 9 further comprising a selectively detachable attachment positioned between said outer surface of said forward face of said forehead portion of said visored component and said fold-down sweatband of said crown component.

20. A modular cap assembly as in claim 9 wherein at least one detachable pocket with one of hook and loop material affixed thereto is attached to a complementary portion of the fold-down sweatband when said crown component is assembled over said visor component.

* * * * *